US010702037B2

(12) United States Patent
Boateng et al.

(10) Patent No.: US 10,702,037 B2
(45) Date of Patent: Jul. 7, 2020

(54) APPARATUS AND METHOD FOR DRYING HAIR

(71) Applicant: Jemella Limited, Leeds, Yorkshire (GB)

(72) Inventors: Eric Boateng, Leeds (GB); Robert James Weatherly, Leeds (GB); Michelle Gin Hua Law, Leeds (GB)

(73) Assignee: Jemella Limited, Leeds (GB)

( * ) Notice: Subject to any disclaimer, the term of this patent is extended or adjusted under 35 U.S.C. 154(b) by 104 days.

(21) Appl. No.: 15/748,101

(22) PCT Filed: Sep. 14, 2016

(86) PCT No.: PCT/GB2016/052848
§ 371 (c)(1),
(2) Date: Jan. 26, 2018

(87) PCT Pub. No.: WO2017/046588
PCT Pub. Date: Mar. 23, 2017

(65) Prior Publication Data

US 2018/0220768 A1 Aug. 9, 2018

(30) Foreign Application Priority Data

Sep. 14, 2015 (GB) ..... 1516247.2

(51) Int. Cl.
*A45D 20/12* (2006.01)
*A45D 2/00* (2006.01)
*A45D 1/06* (2006.01)

(52) U.S. Cl.
CPC ..... *A45D 20/122* (2013.01); *A45D 1/06* (2013.01); *A45D 2/001* (2013.01); *A45D 2/002* (2013.01); *A45D 2200/207* (2013.01)

(58) Field of Classification Search
CPC ..... A45D 20/122; A45D 1/16; A45D 2/001; A45D 2200/207
(Continued)

(56) References Cited

U.S. PATENT DOCUMENTS 7,481,228 B2 * 1/2009 Ragosta ..... A45D 1/04 132/238
9,848,683 B2 * 12/2017 Sayers ..... A45D 1/04
(Continued)

FOREIGN PATENT DOCUMENTS

CA 2688847 A1 6/2011
CA 2688847 A1 6/2011
(Continued)

OTHER PUBLICATIONS

Search Report for British Patent Application No. 1516247.2, dated Mar. 2, 2016.
(Continued)

*Primary Examiner* — Stephen M Gravini
(74) *Attorney, Agent, or Firm* — Schwegman Lundberg & Woessner, P.A.

(57) ABSTRACT

An apparatus for drying hair includes first and second mutually-opposing arms adapted for movement between an open configuration for receiving a length of wet hair therebetween and a closed configuration adjacent the hair. A vibrator imparts vibration from at least one of the arms to the length of hair in use, to move and separate hair fibres for improving drying of the hair. A method of drying hair includes using the apparatus to impart vibration to a length of wet hair held within the apparatus. The method may further include using the apparatus to style the hair substantially simultaneously with drying the hair.

48 Claims, 16 Drawing Sheets

(58) Field of Classification Search
USPC ..... 34/95–100
See application file for complete search history.

(56) References Cited

U.S. PATENT DOCUMENTS

| | | | | |
|---|---|---|---|---|
| 2010/0147324 | A1 | 6/2010 | Hafemann | |
| 2012/0312319 | A1 | 12/2012 | Uwano | |
| 2013/0263881 | A1* | 10/2013 | Story | A45D 2/001 132/223 |
| 2015/0047667 | A1 | 2/2015 | Mandica et al. | |
| 2015/0173477 | A1 | 6/2015 | Leung | |
| 2015/0265024 | A1* | 9/2015 | MacLaine | A46B 15/003 132/271 |
| 2016/0302546 | A1* | 10/2016 | Fan | A45D 1/04 |
| 2017/0164707 | A1* | 6/2017 | Cowdry | H05B 3/06 |
| 2018/0055177 | A1* | 3/2018 | Thompson | A45D 1/28 |
| 2018/0193786 | A1* | 7/2018 | Imhasly | B01D 46/0024 |
| 2018/0220768 | A1* | 8/2018 | Boateng | A45D 1/06 |
| 2019/0008349 | A1* | 1/2019 | Strutt | A47L 9/02 |

FOREIGN PATENT DOCUMENTS

| | | | | | |
|---|---|---|---|---|---|
| EP | 2135522 | A1 | | 12/2009 | |
| EP | 2289366 | A1 | | 3/2011 | |
| EP | 2433519 | A1 | | 3/2012 | |
| EP | 2433519 | A1 | | 3/2012 | |
| GB | 2498417 | A | | 7/2013 | |
| JP | 2017094096 | A | * | 6/2017 | A45D 20/10 |
| JP | 2017140363 | A | * | 8/2017 | A45D 2/001 |
| WO | WO-2017046588 | A1 | | 3/2017 | |
| WO | WO-2017046588 | A9 | | 3/2017 | |
| WO | WO-2017046588 | A9 | * | 5/2017 | A45D 1/06 |
| WO | WO-2017098199 | A1 | * | 6/2017 | A45D 2/001 |

OTHER PUBLICATIONS

International Search Report and Written Opinion for PCT/GB2016/052848, dated Dec. 2, 2016.

"International Application Serial No. PCT/GB2016/052848, International Search Report dated Dec. 2, 2016", 4 pgs.

"International Application Serial No. PCT/GB2016/052848, Written Opinion dated Dec. 2, 2016", 5 pgs.

* cited by examiner

M
10
36
25d
24d
14b
25c
24c
20
12
26
22
35
40
40'
14a
24a
24b
25a
25b
14

100%
% of Unbound Water in Hair
0%
S3
Conduction
Convection &
Vibration
S2
Conduction
S1
Hair Path (distance/time)
$T_{ambient}$
Hair Temperature (°C)

APPARATUS AND METHOD FOR DRYING HAIR

This application is a National Stage Application of PCT/GB2016/052848, filed Sep. 14, 2016, which claims benefit of British Patent Application No. 1516247.2, filed Sep. 14, 2015, which applications are incorporated herein by reference. To the extent appropriate, a claim of priority is made to each of the above disclosed applications.

FIELD OF THE INVENTION

The present invention relates to an apparatus for drying the hair of a person (or conceivably an animal), for example after washing the hair or as part of a styling process. Such drying of the hair may be performed by a user in respect of their own hair, for example, or by a hair stylist.

As those skilled in the art will appreciate, the expressions "to dry hair", "drying hair" and such like, as used herein, should be taken to refer to the removal of "unbound" water that exists on the outside of hair when wet. Such "unbound" water should be contrasted with "bound" water, which exists inside individual hairs, and which can be interacted with when heat styling hair. There is no requirement to remove this "bound" water when drying hair in the context of the present invention, although of course removal of some bound water may also occur during the drying/styling process.

BACKGROUND TO THE INVENTION

Conventional handheld hairdryers, that incorporate an electrically-powered motorised fan to blow a current of cool or hot air in order to dry a person's hair, are well known. The fan draws ambient air into the body of the hairdryer and blows the current of air towards the hair to be dried. When hot air is to be blown, typically an electric heating element, incorporated within the body of the hairdryer, is used to heat the current of air before it leaves the hairdryer. Optionally, the hairdryer may be equipped with a concentrator nozzle attachment to intensify and direct the current of air, or a diffuser attachment to deliver the air more gently.

Although conventional hairdryers have been in use for many years, the inventors have observed and identified a number of shortcomings, as follows:

Conventional hairdryers can often be noisy, heavy and bulky. Furthermore, they can be awkward to use, and it can be difficult for a user (in particular a domestic user attending to their own hair) to achieve desired results, particularly in respect of styling the hair whilst drying it. For instance, a hairdryer will often be used simultaneously with a hairbrush or comb, or another piece of styling equipment, to style the hair during drying. The styling process may be, for example, to straighten the hair, or to provide "body and volume" to the hair (if necessary, preceded or succeeded by the application of styling products such as mousse, gel, wax, hairspray, etc.). Simultaneously maneuvering a hairdryer and a brush (or a comb, etc.) around the head can be awkward for the user, and often requires a degree of skill to achieve the desired results.

Moreover, it has been found that, with too gentle a flow of air it can take an unduly long time to dry the hair. Conversely, with too powerful a flow of air (e.g. using a concentrator nozzle), insufficient control can be provided during a styling operation.

Additionally, excessive use of hot air can result in damage to the hair, whereas the use of cool air can again result in the drying process taking an unduly long time.

Consequently there is a desire for hair drying apparatus that can be used to dry hair in a relatively quick manner, whilst also facilitating styling of the hair.

Furthermore, as illustrated in FIG. 13, the use of a conventional hairdryer to dry hair can be hampered by wet hair clinging together to form clumps, creating surface tension between the hair and making it hard for air from the hairdryer to pass though the hair (e.g. between individual hairs) to dry it. That is to say, clumps of wet hair have relatively high airflow resistance, impeding the drying process.

The clinging-together of wet hair into clumps can also give rise to further problems when the hair is subjected to hot air blown by a conventional hairdryer. In particular, the hair on the outside of a clump dries more quickly than the hair on the inside of the clump. Consequently, the hair on the outside of the clump can be damaged (e.g. scorched) by the hot air, whilst the hair on the inside of the clump can remain wet.

Blowing hot air using a conventional hairdryer can also be inefficient in respect of energy usage, as much of the energy in the hot air is lost into the atmosphere as waste heat. This is particularly the case if the hot air is deflected from a clump of wet hair, rather than being allowed to pass between hairs. This is illustrated in FIG. 13, in which a clump of wet hair 40 is shown in cross-section. An incident flow of hot air 56 is deflected by the clump of wet hair 40. Unbound water (as denoted by 51 in the enlargement) is shown on the surface of the individual hairs within the clump.

Furthermore, with such a clump, the "active" surface area of the hair (i.e. the surface area of the hair that is exposed to air, and from which evaporation of water can occur) is relatively small in comparison to the overall surface area of the constituent hairs added together, again giving rise to inefficiency in the drying process.

Indeed, more generally, conventional hairdryers have been found to be inefficient in respect of heat transfer and evaporation (i.e. low drying efficiency) and power consumption (i.e. low energy efficiency).

To address some of the above issues, hairdryers which blow more air and/or generate higher pressure air (e.g. so as to force the air through clumps of wet hair) have been considered as possible solutions, but this would likely lead to an increased size and weight of the hairdryer, increased operating noise, and greater inefficiency.

There is therefore a desire for an alternative approach to addressing at least some of the above issues.

SUMMARY OF THE INVENTION

The present invention aims to provide alternative apparatus and methods to those of conventional handheld hair driers in order to dry hair. Embodiments of the invention preferably take a similar form to that of a handheld hair straightener or styler, having first and second mutually-opposing arms which are coupled together by a "hinge" and which are movable relative to one other by virtue of the hinge. The mutually-opposing arms incorporate means to impart vibration to wet hair, to shake off excess water and to promote the drying process. In presently-preferred embodiments the mutually-opposing arms also function as styling arms for the purpose of straightening or otherwise styling the hair. Thus, advantageously, embodiments of the present invention provide, as a single handheld device, means for both drying and styling the hair, which is simple to use, and less awkward than maneuvering a conventional hairdryer around the head simultaneously with a brush, comb or other piece of styling equipment.

More particularly, the vibration imparted on the hair may be of an amplitude and frequency sufficient to cause hairs, which have clumped together when wet, to move and separate (e.g. breaking the surface tension between adjacent wet hairs), thereby increasing the overall surface area of the wet hair exposed to air, and allowing air to pass between the hairs.

According to a first aspect of the present invention there is provided apparatus for drying hair, comprising: first and second mutually-opposing arms adapted for movement between an open configuration for receiving a length of wet hair therebetween and a closed configuration adjacent the hair; and means for imparting vibration from at least one of said arms to said length of hair in use, to move and separate hair fibres for improving drying of the hair.

As a result of this movement and separation of wet hair fibres, by virtue of the imparted vibration, the overall surface area of the wet hair exposed to air is increased, and air is able to pass between the hair fibres, thereby promoting evaporation of water from the surface of the hair fibres. As a result, it may, for example, be possible to dry the hair more quickly or with less energy than would otherwise be the case. Furthermore, in accordance with presently-preferred embodiments, and as mentioned above, the arms may also be used to style the hair, thus providing a dual-purpose device for drying and substantially simultaneously styling the hair.

The means for imparting vibration are preferably configured to impart vibration at a frequency and amplitude sufficient to break surface tension between adjacent wet hair fibres, and thereby cause hairs, which have clumped together within said length of hair, to move and separate.

The apparatus may also include means for applying a hair product onto the hair before or whilst it is vibrated by the vibrating means. The vibration applied to the hair helps to disperse the hair product through the hair. Such a product may be hair gel or the like to hold the hair style once set or it may be a hair protection product that protects the hair from, for example, heat damage. Optionally, the means for applying a hair product may include means for atomising the hair product, such as an aerosol nozzle, to provide a fine, even distribution of the hair product over the hair fibres treated by the apparatus.

The means for imparting vibration may comprise one or more mechanical vibration-imparting members mounted on the at least one arm and configured to move relative to the at least one arm in order to impart the vibration to said length of hair. The movement of the vibration imparting members may be a reciprocating movement or a rotational movement.

The apparatus may further comprise means for blowing or drawing air through said length of hair. One example of such a means for blowing or drawing air is a fan. Such an airflow further promotes evaporation of water from the surface of the hair fibres. The apparatus may further comprise means for heating said air, such as one or more heater elements, and may also comprise means for controlling the heating that is applied by the heating elements.

The first and second arms, when in the closed configuration, may define a chamber across which, in use, the hair passes, and inside which the means for imparting vibration act on the hair. The term "chamber" as used herein should be interpreted broadly, to encompass chambers that are partially open on at least one side, as well as those that are enclosed.

Further, the means for blowing or drawing air may be arranged to blow or draw air though said chamber. The chamber therefore functions as a plenum chamber, directing the flow of air through (and around) the hair therein.

The apparatus may further comprise one or more plates disposed on the first and second arms, the plate(s) being arranged to contact the hair when the first and second arms are in the closed configuration.

For example, the apparatus may comprise mutually-opposing plates disposed on the first and second arms, the mutually-opposing plates being arranged to come together when the first and second arms are in the closed configuration, and sandwich therebetween the wet hair in use. Such mutually-opposing plates can advantageously carry out a "squeegeeing" effect on wet hair that is drawn between the plates in use, thereby removing excess unbound water from the hair. Usually, the means for vibrating is provided separately from these mutually-opposing plates.

Further, first and second plates may be disposed on the first arm, and respective opposing first and second plates may be disposed on the second arm. By providing first and second plates on each arm, the apparatus can be used either way around as it is moved along a length of hair. Additionally, by providing a gap between the first and second plates, a space may be provided in which the hair can vibrate.

In one embodiment, one of the first and second arms is bifurcated to form two sub-regions, the first plate of that arm being disposed on one of the sub-regions and the second plate of that arm being disposed on the other of the sub-regions. The means for imparting vibration may be located in the gap between these sub-regions.

More generally, the plates may be incorporated in the walls of the chamber formed when the first and second arms are in the closed configuration. Accordingly, the plates may define the points of contact between the hair and the chamber in use.

At least one of said plates may comprise means for applying heat to said length of hair in use, when the first and second arms are in the closed configuration. Such means for applying heat may comprise, for example, a heater element disposed within or underneath the respective plate, thereby causing the plate to function as a heater plate. Both the plates in a mutually-opposing pair of plates may be heated. Alternatively, only one may be heated (and the other may, for example, be "dummy" or passive, drawing heat from the plate that is heated, when the plates are brought together).

The application of heat from such heater plates promotes drying of the hair and can also be used to style the hair. The heat from the heater plates may also be used to heat the chamber, although separate means for heating the chamber may optionally be provided, disposed on or within the walls of the chamber.

Optionally, the apparatus may further comprise a moisture and/or temperature sensor arranged to detect, in use, the moisture level or temperature of the hair, and control means (e.g. a suitably programmed microprocessor) configured to adjust, in dependence on the detected moisture level of the hair or temperature of the hair, one or more of: the rate with which air is blown or drawn though the chamber, the temperature to which said air is heated, the temperature of said at least one of said plates, and/or the temperature to which the chamber is heated. Thus, as the moisture level of the hair decreases, the applied temperature and/or airflow may advantageously be reduced, thereby saving energy and avoiding the likelihood of damage to the hair.

In one embodiment, temperature sensors are provided at the hair inlet and at the hair outlet, and the controller uses the sensed temperature difference between the inlet and the outlet to determine the orientation that the user is holding the device when in use. This knowledge can also be used to control the heating applied at the hair inlet and at the hair outlet. For example, higher temperatures may be applied at the outlet to allow improved styling of the user's hair.

Also optionally, the apparatus may further comprise a sensor arranged to measure, in use, the amplitude of movement of the hair due to the imparted vibration, and control means configured to adjust the frequency and/or amplitude of the imparted vibration so as to substantially maximise, or achieve a predetermined level of, the measured amplitude of movement of the hair—e.g. adjusting the frequency of the imparted vibration to a frequency at or near the resonant frequency of the hair (which can vary with time, or due to other factors such as the physical characteristics of the user's hair). By operating at or near the resonant frequency of the hair, this increases the amount of movement of the hair obtained for a given amplitude of imparted vibration, and thereby increases the efficiency of the water removal process.

The means for imparting vibration may take a variety of possible forms.

For example, the means for imparting vibration may comprise one or more vibrating or rotating members arranged to contact the hair in use.

The or each vibrating or rotating member may, for example, comprise a vibrating or rotating plate.

In accordance with certain embodiments, such a vibrating or rotating plate preferably extends away from the surface of at least one of the first and second arms and is arranged such that the edge of the vibrating or rotating plate contacts the hair in use. The or each vibrating or rotating plate is preferably oriented longitudinally (i.e. lengthways) with respect to the chamber.

In one embodiment a single vibrating or rotating plate may be arranged along substantially the midpoint of one of the first and second arms.

In another embodiment, first and second vibrating plates may be respectively arranged on the first and second arms. The first and second vibrating plates are preferably driven in synchronism with one another, such that one plate moves away from its respective arm whilst the other plate moves towards its respective arm, and vice versa. The first and second vibrating plates may, for example, be respectively arranged along substantially the midpoint of the first and second arms. Alternatively, the first vibrating plate may be arranged towards one side of the first arm, and the second vibrating plate may be arranged towards the other side of the second arm.

Optionally the surface of the or each vibrating or rotating plate that contacts the hair in use may have a nonplanar profile configured such as to cause hairs that contact the plate to move away from the plate in a direction that is not parallel to the direction of vibrational motion of the plate. In turn, this may promote the movement and separation of clumped wet hairs.

In an alternative embodiment, the or each vibrating member may comprise one of the plates (heated or otherwise) that come together when the first and second arms are in the closed configuration.

In other embodiments, the or each vibrating or rotating member may comprise some other mechanical article such as a cam, an eccentric disc or a rod that is arranged to contact the hair directly in use, to impart vibrations directly to the hair.

The or each vibrating or rotating member may be driven in a variety of possible ways. For example, a motor may be arranged to drive the or each vibrating or rotating member. In embodiments having a fan, said motor may also be arranged to drive the fan. The motor may directly drive the vibrating or rotating member via a shaft of the motor or the vibrating or rotating member may be driven indirectly using, for example, a flexi-drive to connect to the motor.

Further, an eccentric disc or cam, driven by the motor, may be provided to drive the or each vibrating or rotating member. Alternatively, a wormdrive arrangement may be used, or a crankshaft and a connecting rod, driven by the motor.

In other embodiments having a fan, the fan may have a motor separate from that which is arranged to drive the or each vibrating or rotating member.

Instead of using a motor, a reciprocating solenoid may be arranged to drive the or each vibrating or rotating member.

In certain embodiments the means for imparting vibration may be driven at a frequency in the range of 10 Hz to 1 kHz. For example, the means for imparting vibration may be driven at a frequency in the range of 20 Hz to 60 Hz, and more particularly at a frequency in the range of 40 Hz to 50 Hz. The optimum frequency also depends on the length of the hair (the path length) that is being vibrated by the apparatus. Typically this should be within 10 mm and 80 mm, and ideally when the means for imparting vibration operates at a frequency in the range of 40 Hz to 50 Hz, the path length is preferably between 15 mm and 30 mm.

In other preferred embodiments the means for imparting vibration may be driven at a frequency in the range of 10 Hz to 1 kHz, preferably at a frequency in the range of 40 Hz to 100 Hz, and more preferably at a frequency in the range of 60 Hz to 80 Hz.

In certain embodiments the means for imparting vibration may be driven with an amplitude of vibration in the range of 0.5 mm to 20 mm. For example, the means for imparting vibration may be driven with an amplitude of vibration in the range of 0.5 mm to 10 mm, and more particularly with an amplitude of vibration in the range of 2.5 mm to 5 mm.

According to a second aspect of the present invention there is provided apparatus for drying hair, comprising: first and second mutually-opposing arms adapted for movement between an open configuration for receiving a length of wet hair therebetween and a closed configuration adjacent the hair; and at least one member disposed on at least one of said arms, said member being configured to impart vibration to said length of hair in use, to move and separate hair fibres for improving drying of the hair.

According to a third aspect of the present invention there is provided a method of drying hair comprising using apparatus according to the first or second aspect to impart vibration to a length of wet hair held within the apparatus, the vibration being such as to cause hair fibres within said length of wet hair to move and separate from each other.

The method may further comprise using the apparatus to style the hair substantially simultaneously with drying the hair.

BRIEF DESCRIPTION OF THE DRAWINGS

Embodiments of the invention will now be described, by way of example only, and with reference to the drawings in which.

In the figures, like elements are indicated by like reference numerals throughout.

DETAILED DESCRIPTION OF PREFERRED EMBODIMENTS

Figure 1:
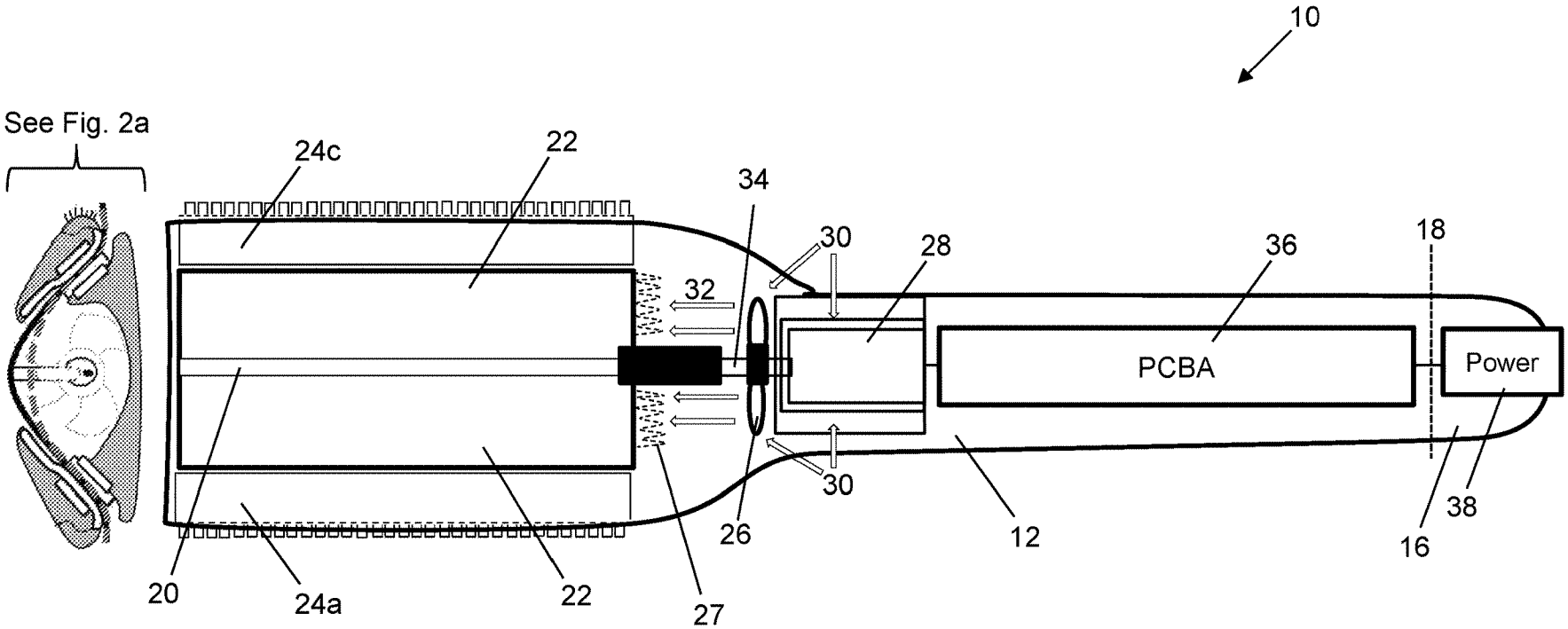
FIG. 1 illustrates a combination hair dryer/styler device (shown schematically in plan view, and in transverse cross-section), the dryer/styler incorporating a vibrating plate to impart vibration to wet hair, together with a heated plenum chamber, heater plates and a fan.

The present embodiments represent the best ways known to the applicants of putting the invention into practice. However, they are not the only ways in which this can be achieved.

Overview of Combination Hair Dryer/Styler Device

The present embodiments provide examples of all-in-one handheld devices that can be used to dry hair in a relatively quick and easy manner, whilst optionally also facilitating styling of the hair (e.g. to add "body and volume" to the hair, or to straighten it). In each case, the device incorporates means for imparting vibration to wet hair, the amplitude and frequency of the vibrations being sufficient to shake off at least some excess water from the hair and to cause hair fibres, which have clumped together when wet, to move and separate, thereby increasing the overall surface area of the wet hair exposed to air, and allowing air to pass between the hair fibres, thereby promoting evaporation of water from the surface of the hairs.

Whilst the following embodiments include a fan or other means for generating a flow of air, alternative embodiments can be realised in which a fan or other means for generating a flow of air is not provided, instead relying on the vibration imparted to the hair to cause the hair to dry.

Also, whilst the following embodiments include means for applying heat to the hair, to promote drying, alternative embodiments can be realised in which no heat is applied to the hair, instead relying on the vibration imparted to the hair to cause the hair to dry.

Indeed, since vibration is used to promote the removal of water from the hair, in comparison with conventional hair-dryers, less (or even no) heat is required, thereby improving the efficiency of the device and removing or at least reducing the likelihood of heat damage to the hair.

The following presently-preferred embodiments, however, use a combination of three principles to provide improved drying performance—namely conduction heating, vibration, and convection heating—as follows:

Conduction heating—to remove excess water via a "squeegeeing" effect and to apply uniform heat distribution across the hair section to excite water molecules (as discussed in greater detail below with reference to FIGS. 2*b* and 3).

Vibration—to break the surface tension in clumps of wet hair and improve drying through evaporation. The inventors have found that providing the apparatus with means to impart vibration to wet hair, to move and separate the hair fibres, is effective in increasing the active surface area of the hair (i.e. the surface area of the hair that is exposed to air, and from which evaporation of water can occur). Accordingly, this removes the need for higher pressure air flow and/or higher volume air flow to achieve improved drying performance.

Convection heating—to provide a flow of air within the device and past the hair, to improve evaporation of water, and to channel water and water vapour away from the hair and out of the device.

First Exemplary Embodiment

FIG. 1 illustrates (schematically in plan view, and in transverse cross-section) a first embodiment of a combination hair dryer/styler device 10. FIG. 2*a* is an enlargement of the transverse cross-sectional view shown in FIG. 1. The device 10 includes a vibrating plate 20 to impart vibration to wet hair, the vibrations being at a frequency and amplitude sufficient to cause hairs, which have clumped together when wet, to move and separate. The device 10 includes a heated plenum chamber 22, heater plates 24*a-d* (each of which may optionally be provided with a comb or bristles to one side, to aid styling), and a fan 26 to deliver a flow of air 32 towards the hair 40 to be dried.

In more detail, the dryer/styler device 10 comprises first and second mutually-opposing arms 12, 14, arranged in a broadly similar manner to the arms of a handheld hair styler. The first arm 12 and the second arm 14 (which is substantially parallel to the first arm, effectively "above" the first arm, and not shown in FIG. 1) are coupled together by a hinge 18, by virtue of which the first and second arms 12, 14 are movable relative to one other. Thus, the first and second arms 12, 14 can be brought together, into a closed configuration, or moved apart, into an open configuration, by a user in use.

The hinge 18 can incorporate any suitable means for allowing the first and second arms 12, 14 to be moved relative to one other.

The hinge 18 also incorporates spring means configured to bias the first and second arms 12, 14 into the open configuration, such that the user is required to apply pressure to the arms to close them together (overcoming the effect of the spring means), and such that the arms 12, 14 automatically open, under the effect of the spring means, once the pressure is removed. For example, the hinge 18 may incorporate a leaf spring or a coiled spring.

The hinge 18 and the spring means can be one and the same. For example, the spring means itself can be used to couple the first and second arms 12, 14 together, thereby avoiding the need to provide a separate mechanical hinge and simplifying the overall construction of the device. Furthermore, the first and second arms 12, 14 may be formed in a unitary manner (e.g. from a plastics material) with a "U" shaped middle part provided between the first and second arms, the "U" shaped middle part being able to resiliently flex to allow opening and closing of the first and second arms 12, 14.

The first arm 12 broadens at the distal end of the device 10 (i.e. distal from the hinge 18) to provide a surface that acts as the "lower" surface of the plenum chamber 22. In effect, the plenum chamber 22 is formed in use by the distal ends of the first and second arms 12, 14 coming together, i.e. when brought into the closed configuration. In the illustrated embodiment the "lower" surface of the plenum chamber 22 (as provided by the first arm 12) is curved, in a manner that broadly corresponds to the shape of the lower half of the fan 26. Thus, air flow generated by the fan 26 is able to flow directly through the plenum chamber 22. First and second heater plates 24*a*, 24*c* are provided either side of the plenum chamber 22 on the first arm 12. Each of the heater plates 24*a*, 24*c* is provided with a respective electrical heating element 25*a*, 25*c*, which are operable to cause the respective heater plates 24*a*, 24*c* to heat up.

Figures 2, 2A, 2B:
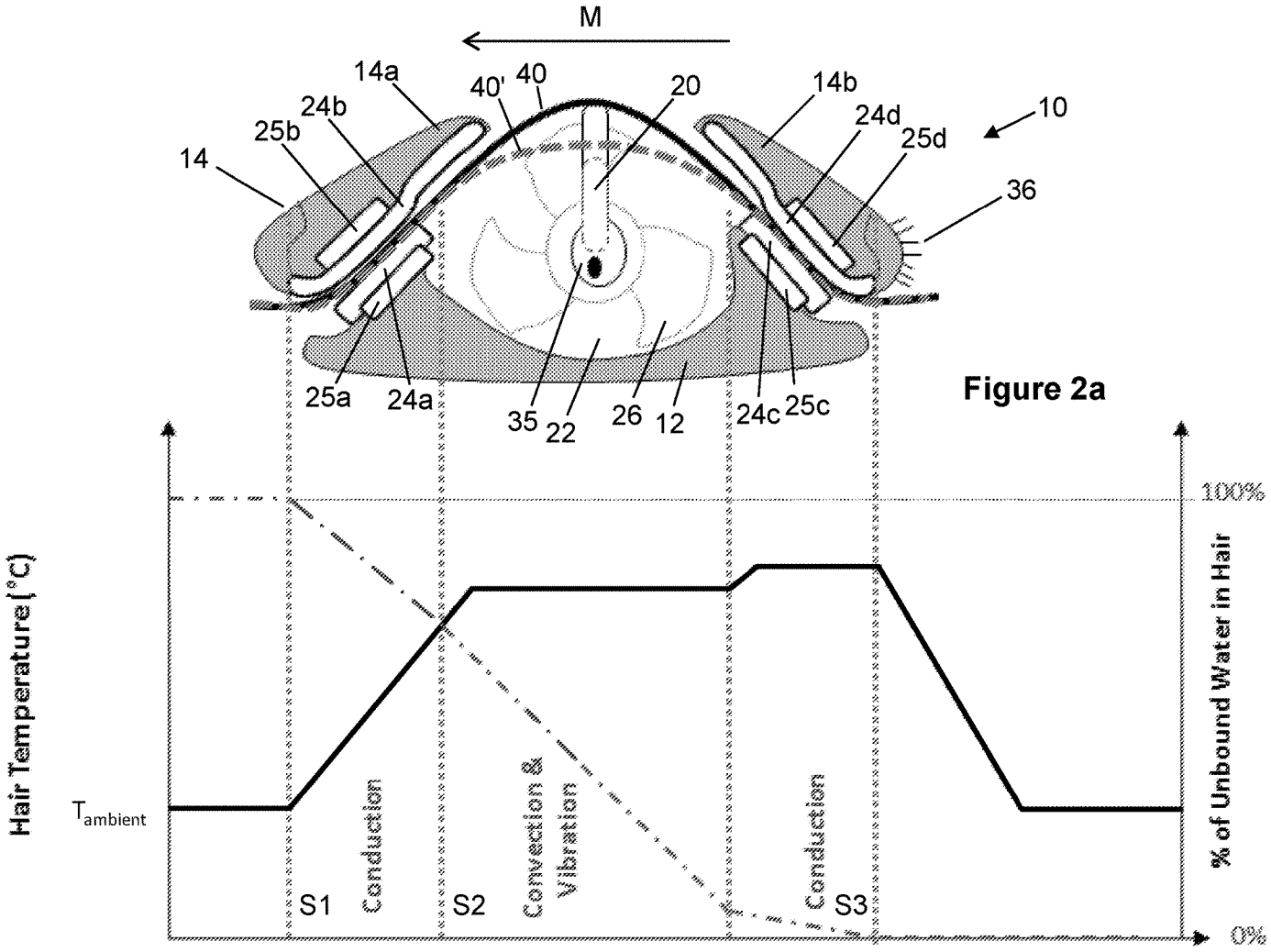
FIG. 2 shows (as FIG. 2*a*) an enlargement of the transverse cross-sectional view of the dryer/styler device of FIG. 1, together with (as FIG. 2*b*) a schematic graph illustrating the drying process as hair is passed through the device, including variations in hair temperature and amount of unbound water with position, and the prevailing heat transfer/water removal mechanisms at each stage.

With particular reference to FIG. 2*a*, the second arm is bifurcated above the broadened region of the first arm 12, to form sub-regions 14*a* and 14*b* of the second arm. Sub-regions 14*a* and 14*b* of the second arm are substantially in mirror symmetry to one another, and are respectively provided with first and second heater plates 24*b*, 24*d*, each of which has a respective electrical heating element 25*b*, 25*d* operable to apply heat to the respective heater plates 24*b*, 24*d*. Due to the symmetric arrangement of the device 10, in use hair can be drawn through the device 10 with the device either way around (i.e. with sub-region 14*b* preceding sub-region 14*a*, or with sub-region 14*a* preceding sub-region 14*b*). Merely by way of example, the device 10 in FIG. 2*a* (and in subsequent figures) is depicted as having a direction of movement M from right to left, i.e. with sub-region 14*a* preceding sub-region 14*b*, although it may alternatively be used in the opposite direction.

The sub-regions 14*a* and 14*b* of the second arm, and the first and second heater plates 24*b*, 24*d* thereon, are arranged such that, when the device 10 is in the closed configuration, the first and second heater plates 24*b*, 24*d* come into contact with the first and second heater plates 24*a*, 24*c* of the first arm 12. Preferably the heater plates 24*a*, 24*b*, 24*c*, 24*d* are made of a material having relatively high thermal conductivity.

A fan 26 is mounted on the first arm 12 and is driven by an electric motor 28. The fan 26 draws in air from the surrounding environment, e.g. via inlets 30, and delivers a flow of air 32 through the heated plenum chamber 22, around and through the hair to be dried. The fan 26 may blow (as illustrated) or draw the air through the plenum chamber 22.

In the case of a flow of air 32 blown by the fan 26, as illustrated, the flow of air 32 may be heated by one or more heater elements 27 disposed proximal to the fan. Alternatively, in the case of a flow of air drawn by the fan, heater elements may be provided at the distal end of the plenum chamber 22 from the fan 26, so as to heat the air as it enters the plenum chamber 22. However, having the fan blow air through the plenum chamber, as illustrated, is considered preferable to having it draw air through the plenum chamber, since blowing the air enables water removed from the hair to be more easily expelled from the device, though the open end of the plenum chamber 22 distal from the fan 26. It also enables the heater element(s) 27 to be mounted within the body of the device, near to the fan 26, as illustrated, which is safer from the user's point of view than having the heater elements mounted at the open end of the plenum chamber 22, distal from the fan.

The heater plates 24*a-d* serve a number of purposes during use of the device 10. Firstly, with the user having sandwiched a length of wet hair 40 between opposing plates 24*a* and 24*b* and between opposing plates 24*c* and 24*d* (i.e. transversely across the plenum chamber 22, with the first and second arms 12, 14 in the closed configuration), and by drawing the device along the length of wet hair 40 (e.g. in direction M, normally away from the user's scalp), the heater plates 24*a-d* subject the wet hair 40 to a squeegeeing effect, removing excess unbound water, and also heat the hair 40 to promote subsequent evaporation of the water. Secondly, the heating provided by the heater plates 24*a-d* causes the walls of the plenum chamber 22 to be heated (via thermal conduction), and also helps maintain the temperature of the air flow 32 delivered through the plenum chamber 22 by the fan 26. (In alternative embodiments, though, the plenum chamber may be provided with its own heating element(s).) Thirdly, the heater plates 24*a-d* can be used to style the hair once dry, the styling effectively being performed as an integral continuation of the drying process.

The heater plates 24*a-d* are preferably configured as float plates with springs having a low spring rate or stiffness, thereby giving good control of hair tension.

The first arm 12 also includes a vibrating plate 20 which is arranged longitudinally with respect to the length of the plenum chamber 22 (i.e. lengthways relative to the plenum chamber 22, at substantially a right angle to the length of hair 40 which passes transversely across the plenum chamber 22 in use). Further, the vibrating plate 20 extends upwardly from the surface of the plenum chamber 22, to such an extent that the upper edge of the plate 20 contacts the transverse length of hair 40 in use, and is configured to vibrate in an "up and down" oscillating manner, i.e. exhibiting reciprocating motion, thereby imparting vibration to the hair 40.

In this embodiment the motion of the vibrating plate 20 is driven by a shaft 34 coupled to the fan 26, and hence is driven by the same electric motor 28 as the fan 26. As those skilled in the art will appreciate, a number of mechanical techniques exist for achieving reciprocating motion of the vibrating plate 20 from the rotary motion of the shaft 34—for example through the use of an eccentric disc or cam 35 (as illustrated in FIG. 2*a*), for example together with a spring or a cam follower; or by using a crankshaft and a connecting rod, etc.

The vibrating plate 20 provides means for imparting vibration to a length of clumped wet hair 40 in use, causing the length of hair to rapidly and repeatedly move between positions 40 and 40' as shown in FIG. 2*a*, and thereby causing the hair fibres to separate (e.g. as a result of breaking the surface tension between adjacent wet hairs). This quickly results in an increase in the "active" surface area of the hair (i.e. the surface area of the hair that is exposed to air, and from which evaporation of water can occur), thereby allowing air to pass between the hairs, and promoting evaporation of water from the surface of the hairs.

The electrical and electronic circuitry of the device 10 is housed within the first and second arms (although predominately within the first arm 12). In the example illustrated, a printed circuit board assembly (PCBA) 36 is provided within the first arm 12. Electrical power is provided to the device 10 by means of a power supply 38 located at the end 16 of the device proximal to the hinge 18. In the presently-preferred embodiment the power supply 38 is an AC mains power supply. However, in an alternative embodiment the power supply 38 may comprise one or more DC batteries or cells (which may be rechargeable, e.g. from the mains or a DC supply via a charging lead), thereby enabling the device 10 to be a cordless product.

As those skilled in the art will appreciate, a switch (not illustrated) may be provided on the device 10 to enable it to be turned on or off, together with an indicator light (not illustrated) to show whether the power is on. A sound can also be played by a sound generator (not illustrated) when the device 10 is switched on and ready to use. Together, the switch, light and sound generator (if included) form a user interface (68 in FIG. 12). In alternative embodiments the user interface may include additional components (such as, for example, further display means, to provide the user with more information on the operational status of the device).

Method of Use

In use, the device 10 is turned on, energising heating elements 25*a-d* and causing heater plates 24*a-d* to heat up and the plenum chamber 22 to be heated. The user then opens the first and second arms 12, 14 and, normally starting from the roots of the hair (i.e. near the scalp), a length of wet hair 40 (which may be clumped) is introduced between the arms 12, 14, transversely across the plenum chamber 22. The user then closes the arms 12, 14 so that the wet hair 40 is held between the first and second arms 12, 14. Thus, the length of wet hair 40 is held between the respective first heater plates 24*a*, 24*b* of the first and second arms 12, 14, and also between the respective second heater plates 24*c*, 24*d* of the first and second arms 12, 14.

Upon closing the arms a micro-switch (not shown) or a user operated button (not shown) is activated which starts the fan 26 to deliver an air flow 32 that is heated by the heater element(s) 27, and that causes the vibrating plate 20 to vibrate. Alternatively, the fan 26 and the vibrating plate 20 may operate continuously once the device is switched on. The vibration of the vibrating plate 20 imparts vibration to the length of wet hair 40 within the plenum chamber 22, causing the hair fibres to move and separate, thereby increasing the overall surface area of the wet hair exposed to the air flow 32, and allowing the air flow 32 to pass between the hair fibres, thus promoting evaporation of water from the surface of the hairs.

The device 10 is pulled along the length of the hair, away from the roots and towards the hair tips, in a manner similar to that which would be employed with a conventional hair styler device, but in this case causing the hair to be dried and (in this embodiment) simultaneously enabling it to be styled. As discussed above, due to the symmetric arrangement of the device 10, the hair can be drawn through the arms 12, 14 in either orientation—i.e. with sub-region 14*b* preceding sub-region 14*a*, or with sub-region 14*a* preceding sub-region 14*b*; and therefore, the user can use the device in either orientation using their left or right hands.

Water Removal Mechanisms

The mechanisms by which water is removed from the wet hair by the device 10 will now be discussed in more detail with reference to FIGS. 2*a* and 2*b*. Specifically, for each of the three stages of heat transfer/water removal identified in FIG. 2*b*, the graph illustrates the variation in hair temperature and the amount of unbound water with position. Reference is also made to FIGS. 3, 4*a*, 4*b* and 5, which illustrate some of the principles and mechanisms employed.

Stage 1—Squeegeeing and Conduction of Heat

Figure 3:
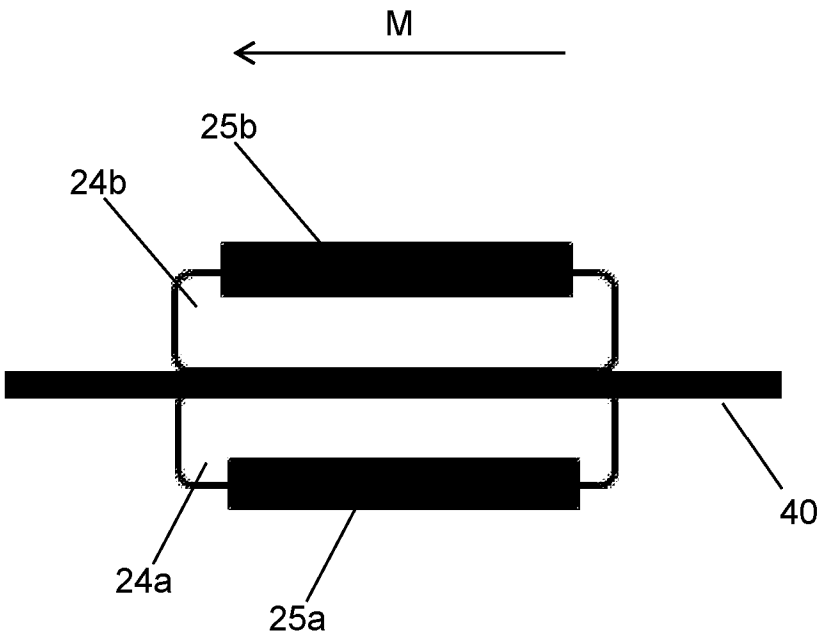
FIG. 3 illustrates the conduction heating of hair as it passes between two surfaces (plates), at least one of which is heated, and an associated squeegeeing effect which helps to remove excess water from the hair.

As illustrated in FIG. 2*b*, in a first stage (S1) of water removal the wet hair 40 passes between a first pair of opposing thermally-conductive heater plates (e.g. plates 24*a* and 24*b* illustrated in FIG. 2*a*), the hair 40 being sandwiched between the heater plates 24*a*, 24*b* as illustrated in FIG. 3. The closed-together heater plates 24*a*, 24*b* are then drawn in a given direction (e.g. direction M) relative to the hair 40. During this process, the hair 40 is subjected to a squeegeeing effect, which removes excess unbound water from the hair. At this stage, the hair temperature also increases due to conduction of heat from said first pair of heater plates 24*a*, 24*b*, thereby exciting the water molecules within the hair fibres and initiating the evaporation process. The uniform distribution of heat across the heater plates 24*a*, 24*b* provides efficient pre-heating of the hair by exciting the water molecules, in preparation for evaporation of the water in the subsequent stages.

Stage 2—Convection and Vibration

As the device 10 is moved along the user's hair, the hair 40 that has been treated in stage 1 enters the plenum chamber 22 and, as a second stage (S2) of water removal, is subjected to vibration from the vibrating plate 20 and a flow of hot air from the fan 26. Vibration forces (due to the vibrating plate) break the surface tension of the wet hair, and move and separate wet hairs that have clumped together. The flow of hot air from the fan 26 (i.e. heat transfer by convection) evaporates the majority of the water content from the surface of the hair, and carries the evaporated water out of the end of the plenum chamber 22 distal from the fan 26.

Figure 4A:
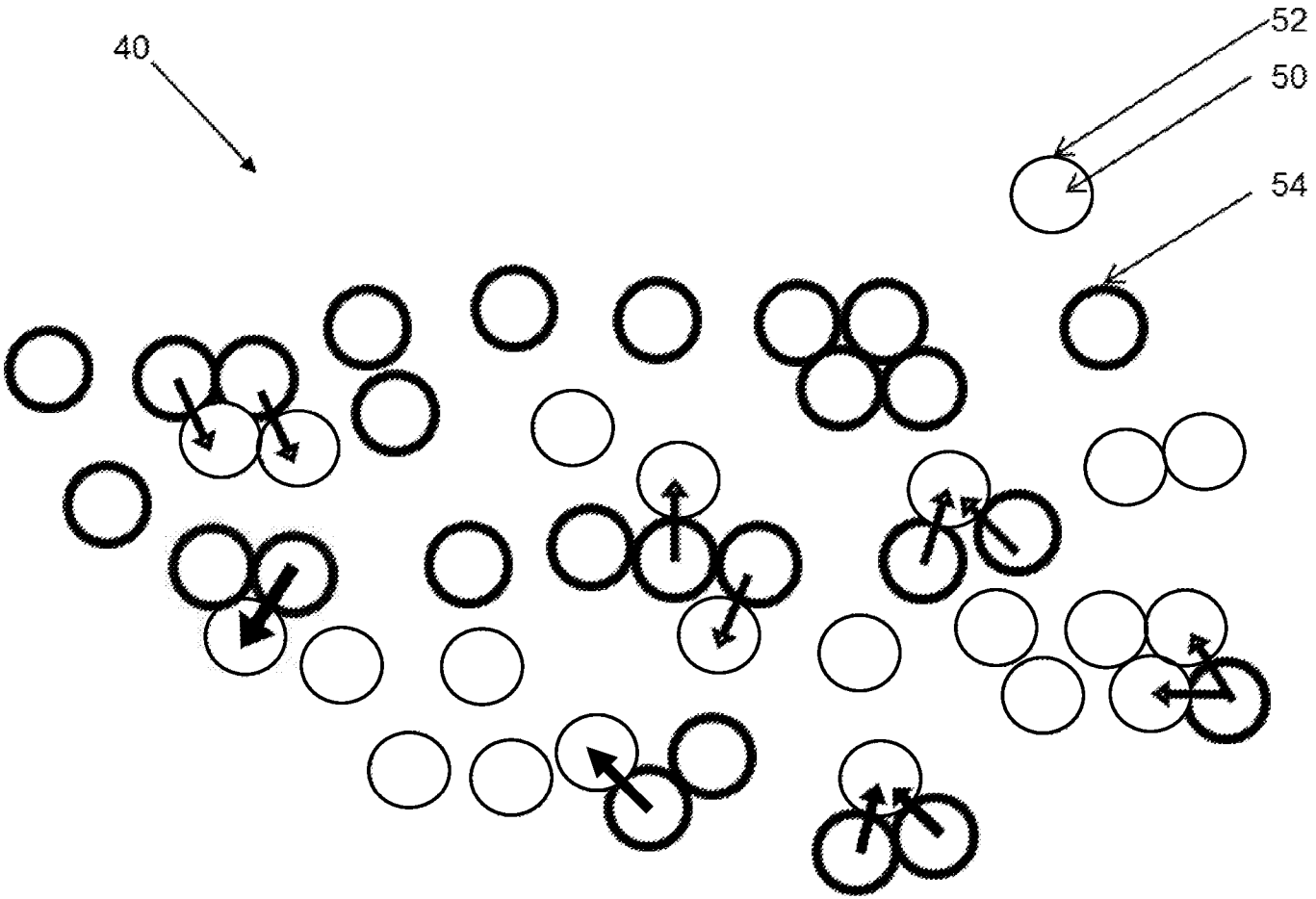
FIG. 4*a* is a cross-sectional schematic diagram illustrating the action of vibration in redistributing water within a clump of wet hair.
Figure 4B:
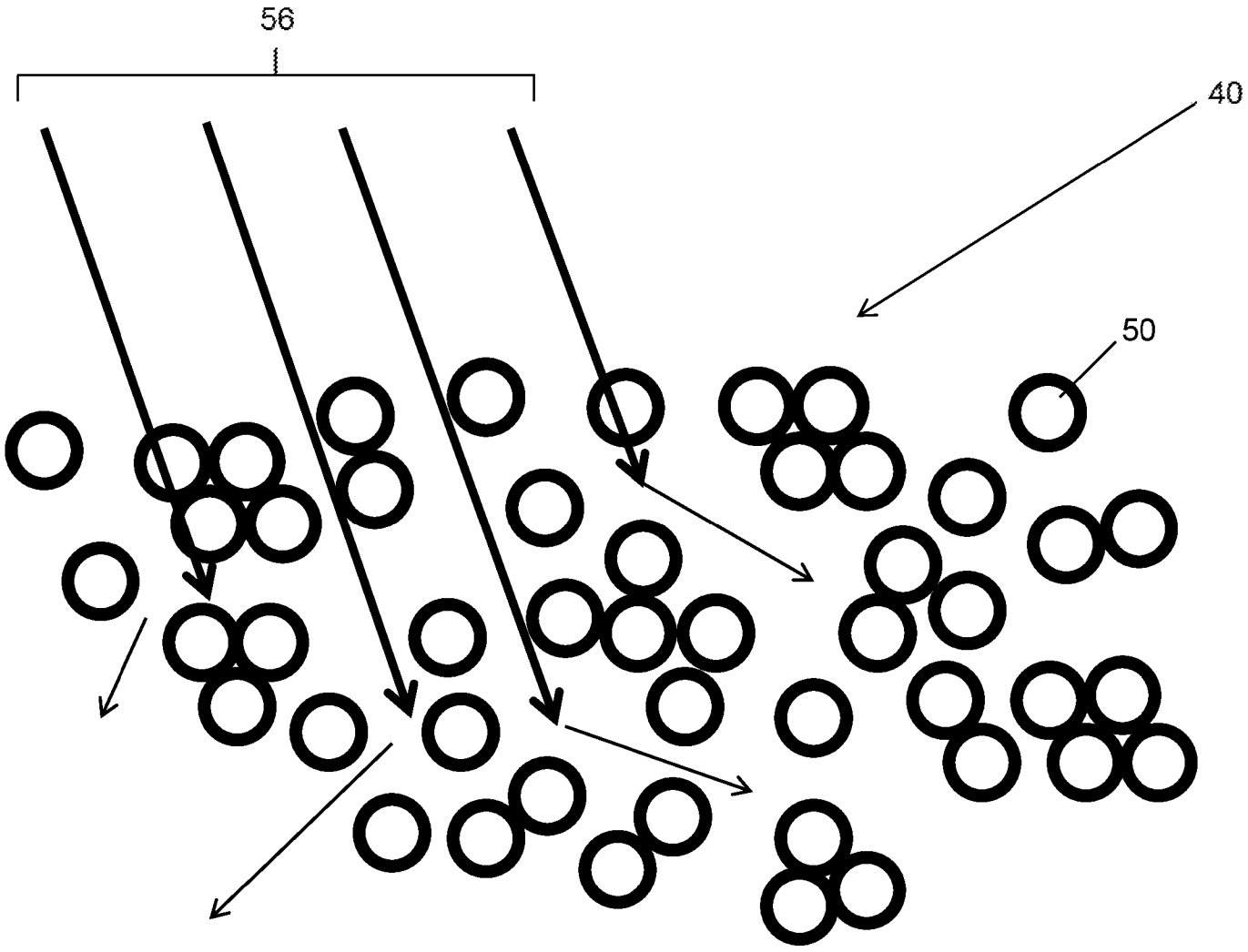
FIG. 4*b* is a cross-sectional schematic diagram illustrating the effects of air flow and vibration in drying the clump of wet hair of FIG. 4*a;*
Figure 5:
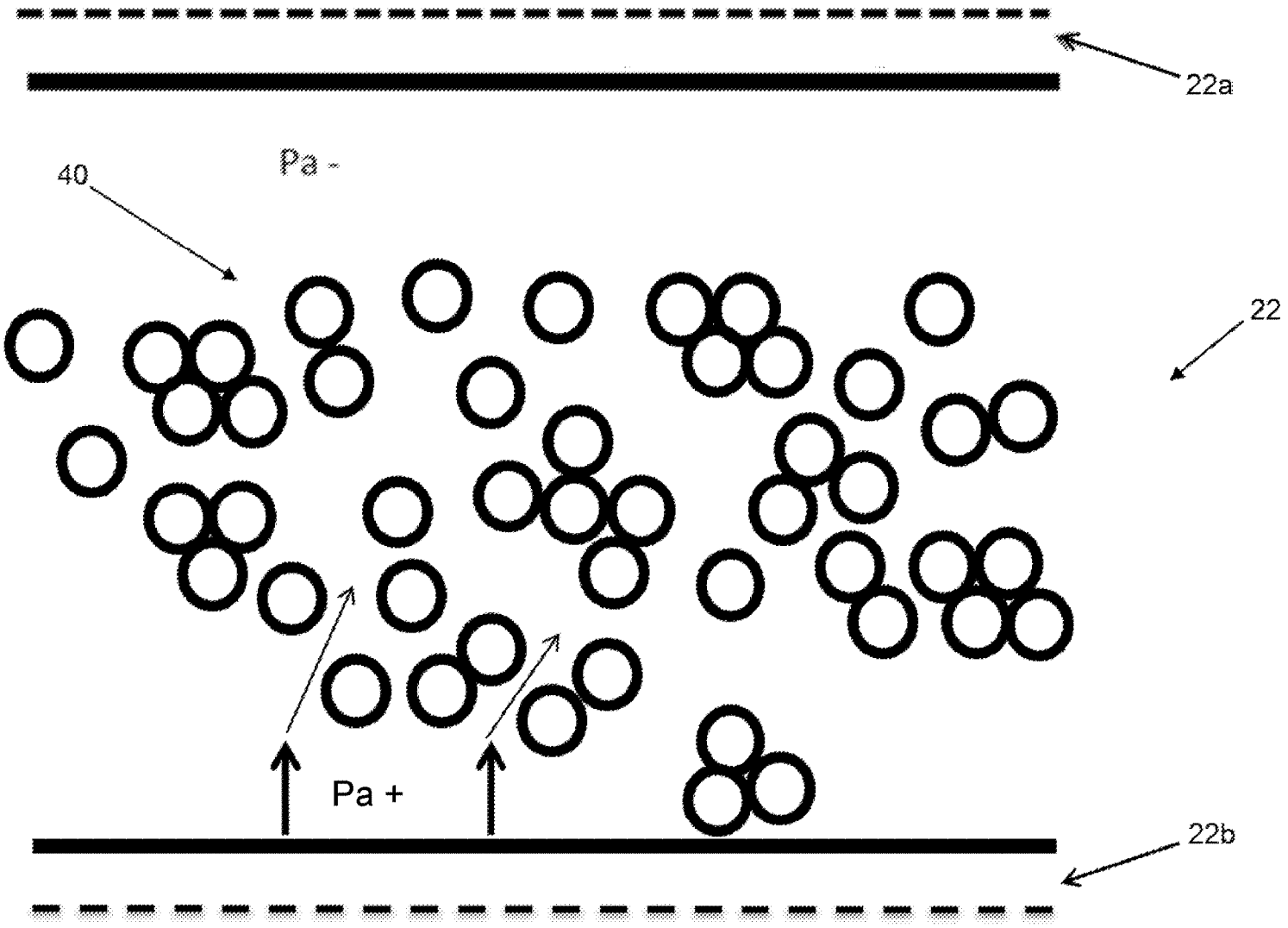
FIG. 5 is a cross-sectional schematic diagram illustrating the drying of hair that is vibrated within a conductively heated plenum chamber.

FIGS. 4*a*, 4*b* and 5 illustrate the mechanisms by which, during this vibration and convection stage, water is evaporated from the hair.

Firstly, FIG. 4*a* illustrates how vibration helps to redistribute water within a section of clumped wet hair 40.

Individual hairs within the clump 40 are denoted by the solid circles 50. Differing amounts of unbound water (e.g. 52, 54) are shown on the surface of the hairs 50. By virtue of the applied vibrations, water is transferred from hairs 50 that have a greater than average amount of water on them (e.g. 54), to hairs that have less than an average amount of water on them (e.g. 52). The arrows between the circles in FIG. 4*a* indicate such redistribution of water between the hair fibres within the section of hair 40.

In addition to redistributing water, the vibration applied to the hair can also be used to distribute various "wet line" products, such as hair gels, hair heat protection products and the like. The vibration helps to distribute the hair product through the hair. A product applicator (not shown) may be provided at the hair inlet that outputs a steady supply of the hair product to the hair that is passing through the inlet. A product applicator (not shown) may also be provided towards the outlet of the device 10, to apply a product that can protect the user's hair from heat damage caused by the heaters at the outlet of the device 10. Moreover, the product applicator may include atomising means (e.g. an aerosol nozzle), to provide a fine mist of the hair product in the chamber through which the hair passes. By virtue of the vibration of the hair within the chamber, this results in an even application of the hair product to the individual hair fibres.

Moreover, through relative movement and separation of the hairs, vibration also increases the active surface area of the hair from which evaporation of water can occur, thus helping the hair to dry more quickly. This also helps to prevent (or at least reduce the occurrence of) temperature differences across the hair section, thereby reducing damage to the hair.

FIG. 4*b* illustrates how vibration of the clump of wet hair 40 enables a flow of air 56 to pass through the hair section with reduced air flow resistance. This is achieved by forces, imparted on the hair due to the vibration, breaking the surface tension in the wet hair, moving and separating the hairs, and thereby reducing air flow resistance. Air flow between hairs 50 is thereby promoted, aiding evaporation of water from the surface of the hairs. Furthermore, the vibrational movement of the hair section can cause a pressure differential across the hair section, thereby creating additional airflow through the section and giving rise to increased evaporation of water. Temperature differences across the hair section are also reduced, as mentioned above.

FIG. 5 illustrates effects of the surface of the heated plenum chamber 22 on the drying of the section of clumped wet hair 40. Specifically, whilst the hair is vibrated, the conductively heated plenum chamber 22 helps to maintain the temperature of the air in the chamber as evaporation of water occurs, thereby maintaining a high rate of evaporation. Moreover, if the hair contacts a heated surface (e.g. 22*a* or 22*b*) of the plenum chamber 22, the surface of the plenum chamber 22 transfers heat into the hair, again maintaining a high rate of evaporation. Further, as the hair moves (due to being vibrated) and comes near to, or into contact with, a heated surface (e.g. 22*b*) of the plenum chamber 22, a region of positive air pressure (Pa+) can be created that helps to push air through the hair section, towards a lower pressure region (Pa−) on the other side of the plenum chamber, thereby further promoting evaporation of the water from the hair.

The surface of the plenum chamber 22 may be smooth, or may be textured or grooved. A textured or grooved plenum surface helps unwanted liquid water to drain away or to evaporate, away from the hair.

Stage 3—Conduction of Heat

Referring again to FIGS. 2*a* and 2*b*, as the device 10 is moved further along the hair, the hair that has been treated in stage 2 passes between the second pair of opposing heater plates (e.g. plates 24*c* and 24*d* illustrated in FIG. 2*a*), as a third stage of water removal (S3). Here, as the hair becomes dry, its temperature reaches a state of equilibrium with the temperature of said heater plates, due to conduction of heat. During this stage, the remainder of the water is evaporated from the surface of the hair. The hair can also be styled by said heater plates during this stage.

With regard to both stages 1 and 3 above, the heater plates 24*a-d* enable good control of both the drying and the styling processes.

Operating Parameters (Optionally with Feedback Control)

Values of various operating parameters that have been found to give good results in respect of the above stages 1-3 will now be discussed.

Stages 1 and 3—Conduction of Heat

Operating the heater plates 24 at a temperature in the range of 30° C. to 185° C. has been found to provide good heat transfer by conduction. However, it is preferred that the heating applied by the heating plates 24 on the hair inlet side is lower than the heating applied by the heating plates 24 on the hair outlet side. In particular, on the hair inlet side, the heating plates are preferably operated in the range of 60° C. to 135° C. 135° C. is the denaturation temperature of wet hair and so, on the inlet heater side (where the hair is likely to be the wettest), the temperature should be kept below 135° C. This also reduces cavitation of water when the wet hair comes into contact with the heater plates 24 on the inlet side. On the outlet side, however, the hair should be dryer and so the heater plates 24 can be operated at a higher temperature (above 135° C.) allowing for better styling/straightening of the hair.

Optionally the device 10 may be provided with a moisture and/or a temperature sensor (64 in FIG. 12), in the plenum chamber 22 and/or at the inlet and/or outlet thereof, together with temperature regulation means, e.g. as a feedback loop system, to regulate the temperature of the heater plate element(s) 25 and/or the fan heater element(s) 27 in dependence on the moisture level or temperature of the hair as sensed by the moisture/temperature sensor. Thus, as the moisture level of the hair decreases, the applied thermal power may be increased. The speed of operation of the fan motor 28 may also be reduced as the moisture level of the hair decreases.

Stage 2—Convection and Vibration

The following parameters for air flow from the fan 26 in the plenum chamber 22 have been found to provide good heat transfer by convection:

Air flow temperature: 30° C. to 185° C.

Static pressure: 20 Pa to 2000 Pa

Air flow rate: 0.03 $m^3$/min to 2 $m^3$/min

Moreover, the following parameters in respect of the vibration frequency and amplitude of the vibrating plate 20 have been found to provide good results in respect of moving and separating wet hairs within a clump:

Vibration frequency: 10 Hz to 1 kHz, preferably 20 Hz to 60 Hz, and more preferably 40 Hz to 50 Hz.

Vibration amplitude (peak to peak): 0.5 mm to 20 mm, preferably 0.5 mm to 10 mm, and more preferably 2.5 mm to 5 mm.

Figure 6:
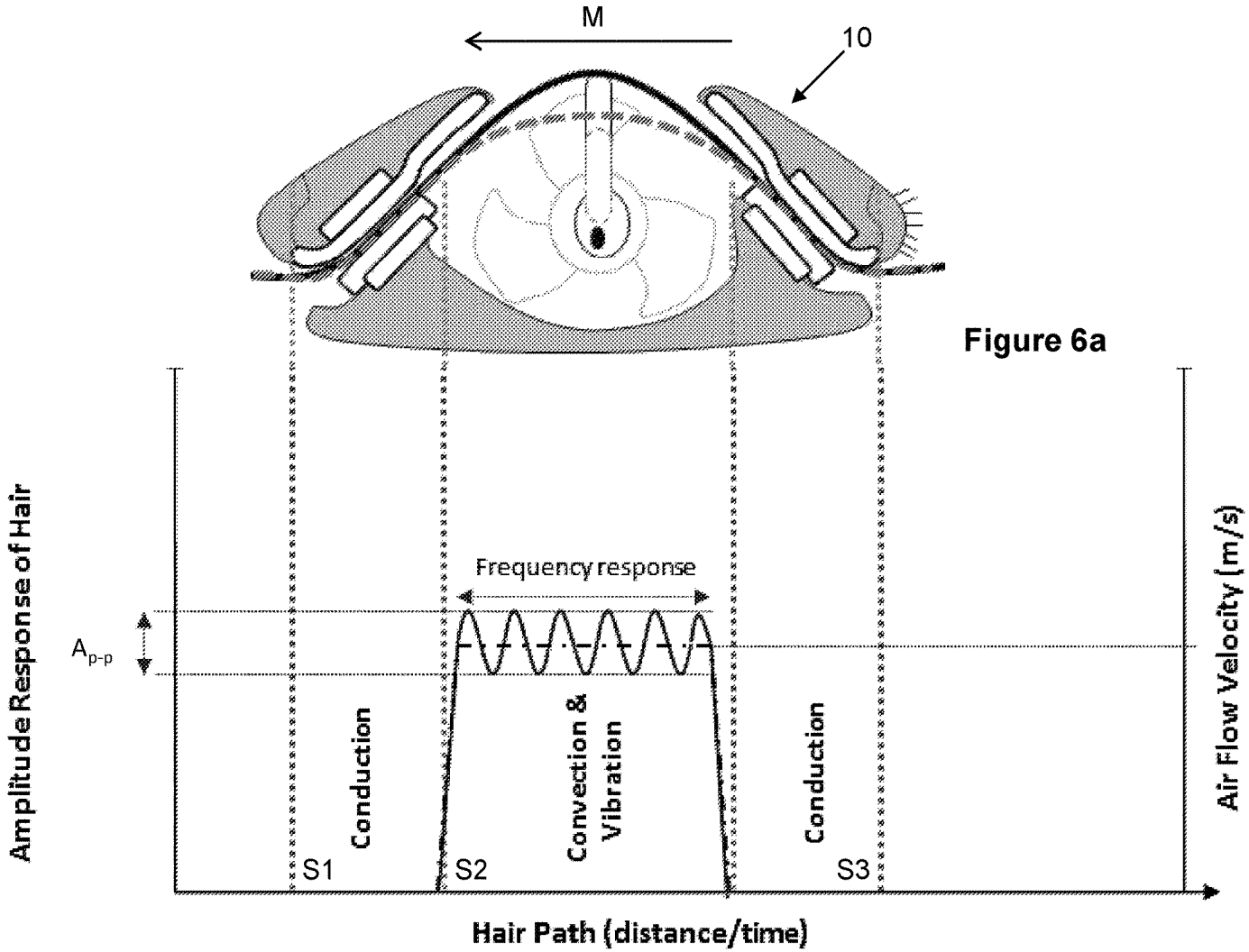
FIG. 6 shows (as FIG. 6*a*) the enlargement of FIG. 2*a* of the transverse cross-sectional view of the device of FIG. 1, together with (as FIG. 6*b*) a schematic graph illustrating the vibrational response of hair as it is passed through the dryer/styler, and also variation in air flow velocity with position.

The inventors have also found that the "path length" of the hair is related to the preferred vibration frequency. Here, the path length is the length of the hair that is held between the inlet and the outlet that is vibrated within the device. With the above preferred ranges of vibration frequencies, the path length is preferably between 10 mm and 80 mm and for the most preferred vibration frequency of 40 Hz to 50 Hz, the path length is preferably between 15 mm and 30 mm. In the devices illustrated in FIGS. 1 and 6, the path length has been made larger than the width of the device by angling the heater plates in the manner shown. This allows the path length of the hair to be optimised for a given width of device.

In other preferred embodiments the vibration frequency is in the range of 10 Hz to 1 kHz, preferably in the range of 40 Hz to 100 Hz, and more preferably in the range of 60 Hz to 80 Hz.

As a general principle, ideally the hair is vibrated at or near its "resonant frequency", in order to obtain maximum (or near-maximum) amplitude of movement of the hair. In this context, the resonant frequency of the hair is dependent on (a) the type of hair; (b) the amount and length of hair in the plenum chamber 22; (c) the amount of water on the hair; and (d) the tension of the hair in the plenum chamber 22.

Thus, the resonant frequency of the hair will vary from person to person, or even, for the same person, from use to use of the device. To allow for this, the dryer/styler device may optionally be provided with user controls (e.g. in the form of a user interface, e.g. 68 in FIG. 12) to enable the user to adjust the vibration frequency of the vibrating plate 20, to suit the hair in question. Alternatively, the device may optionally be provided with a feedback circuit incorporating a sensor (66 in FIG. 12) which measures the amplitude of movement of the hair, and a controller which adjusts (e.g. periodically) the frequency of the vibrations applied by the device, in response to the measured amplitude of movement of the hair, so as to maximise (or achieve a predetermined level of) the measured amplitude of movement of the hair.

Such a feedback system may be combined with the temperature control feedback system mentioned above. For example, a single microprocessor controller (62 in FIG. 12) may serve as the controller for both the vibration frequency feedback control and the heater plate temperature feedback control.

Amplitude and Frequency of Vibrational Response of the Hair

With reference to FIGS. 6*a* and 6*b*, the vibrational response of the hair in the plenum chamber 22 due to vibration of the vibrating plate 20 (i.e. during the convection and vibration stage, S2) is illustrated. Because of resonant effects between the vibrating plate 20 and the hair, in response to vibration of the plate 20 at a given frequency, the amount of displacement of the hair in the plenum chamber 22 depends on the same factors (a) to (d) mentioned above, i.e. (a) the type of the hair; (b) the amount and length of hair in the plenum chamber; (c) the amount of water on the hair; and (d) the tension of the hair in the plenum chamber 22. As shown, the vibrational response of the hair rapidly drops away close to the edges of the plenum chamber 22 (i.e. near to the heater plates 24*a-d*).

The graph in FIG. 6*b* also illustrates the variation in air flow velocity (i.e. in respect of air flow 32) with position, showing that it is substantially constant across most of the plenum chamber 22, but rapidly drops away close to the edges of the plenum chamber 22 (i.e. near to the heater plates 24*a-d*).

Second Exemplary Embodiment

Figure 7A:
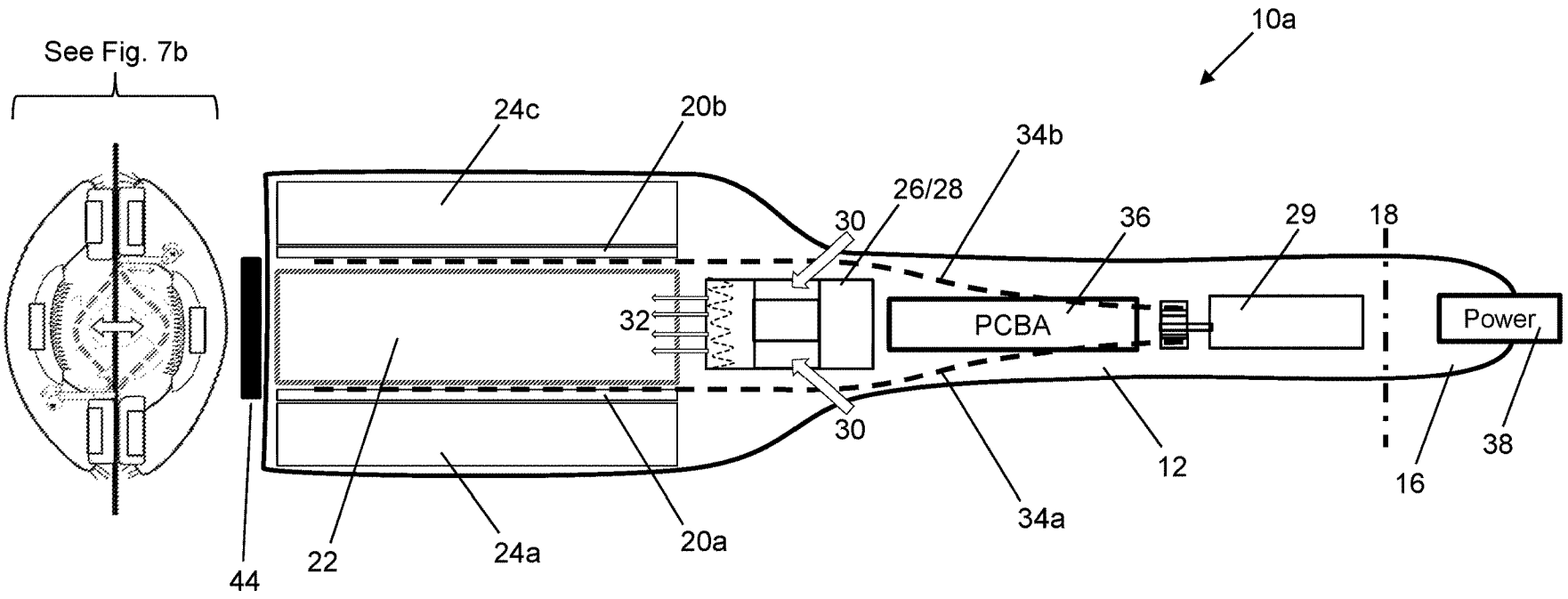
FIG. 7*a* illustrates a second combination hair dryer/styler device (shown schematically in plan view, and in transverse cross-section), the dryer/styler incorporating a pair of vibrating plates to impart vibration to wet hair, together with a heated plenum chamber, heater plates and a fan.
Figure 7B:
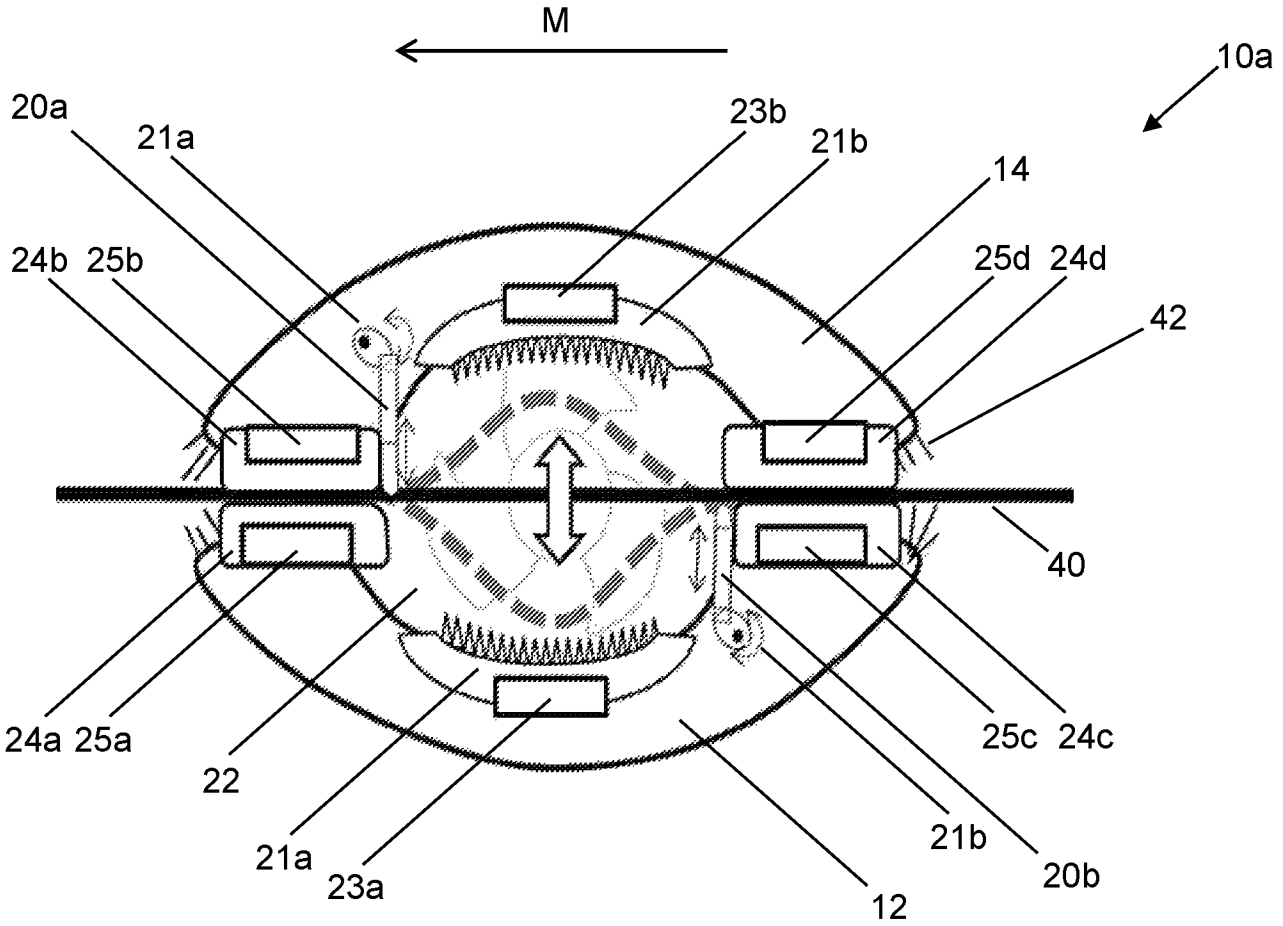
FIG. 7*b* is an enlargement of the transverse cross-sectional view of the dryer/styler device of FIG. 7*a;*

FIG. 7*a* illustrates (schematically in plan view, and in transverse cross-section) a second embodiment of a combination hair dryer/styler device 10*a*. FIG. 7*b* is an enlarged view of the transverse cross-section of the device 10*a*. This device has a number of features in common with the first embodiment device 10, as indicated by the use of like reference numerals, which need not be described again.

Key differences over the first embodiment include the provision of two vibrating plates 20*a* and 20*b* (rather than a single vibrating plate 20) in the plenum chamber 22, and the provision of a separate motor 29 (i.e. separate from the fan motor 28) to drive the vibrating plates 20*a*, 20*b*. The motor 29 drives the vibrating plates 20*a*, 20*b* via dedicated shafts (or so-called "flexi drive" connections) 34*a* and 34*b*, separate from the fan 26. This allows the vibrating plates 20*a*, 20*b* to be operated and controlled independently of the operation of the fan 26.

As shown in the transverse cross-section in FIG. 7*b*, another difference of the second embodiment device 10*a* relative to the first embodiment device 10 is the provision of a unitary (rather than bifurcated) second arm 14, broadly symmetrical with the first arm 12 and arranged to close in a clamshell-like manner about the length of hair 40 that is to be dried at any given time within the device 10*a*. As with the first embodiment device 10, the length of hair 40 is held between the respective first heater plates 24*a*, 24*b* of the first and second arms 12, 14, and also between the respective second heater plates 24*c*, 24*d* of the first and second arms 12, 14.

Moreover, as shown in the transverse cross-section in FIG. 7*b*, in the device 10*a* of this second embodiment one of the vibrating plates (i.e. plate 20*b*) may be mounted on the first arm 12, within the plenum chamber 22, whereas the other of the vibrating plates (i.e. plate 20*a*) may be mounted on the second arm 14, also within the plenum chamber 22, and facing in the opposite direction to the first plate 20*b*. The vibrating plates 20*a*, 20*b* act near each of the end nodes of the hair (the nodes being defined by the points where the hair is contacted (or gripped) by the heater plates 24*a-d*), with the vibrating plates 20*a*, 20*b* pushing the hair 40 in synchronism with one another, in an alternating manner, in opposite directions to each other.

As shown in the transverse cross-section in FIG. 7*b*, the device 10*a* of the second embodiment may also include supplementary heater plates 21*a*, 21*b* (with corresponding supplementary heater elements 23*a*, 23*b*) disposed within the plenum chamber 22, in the centre of the opposing faces of the first and second arms 12, 14, to provide additional heating to the plenum chamber 22 and thus to the flow of air 32 and the length of hair 40 held within.

As also shown in the transverse cross-section in FIG. 7*b*, styling means 42 may be provided at the inlet and outlet of the device 11*a*, through which the length of hair 40 passes, to impart specific styling processes on the hair as it is dried (such as combing).

Further, as illustrated in the plan view of FIG. 7*a*, a diffuser 44 may be provided at the outlet of the plenum chamber 22, to dissipate hot air expelled from the device. The diffuser 44 may also act to divert air towards the root of the hair on starting a new length of hair, when the device is closed.

Third Exemplary Embodiment

Figure 8:
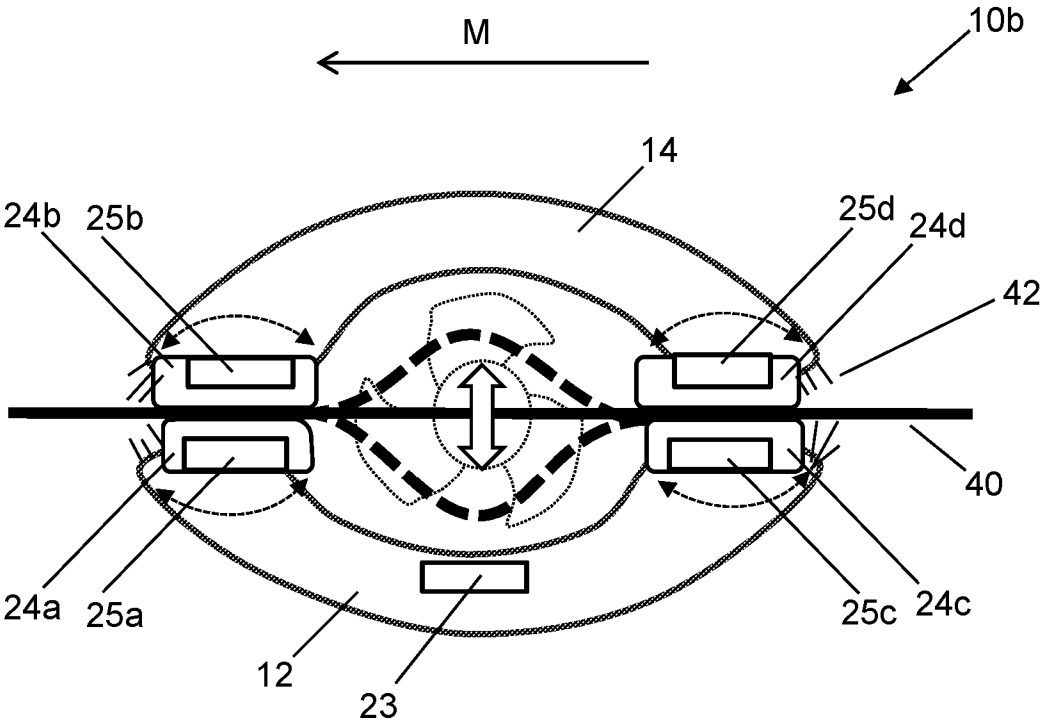
FIG. 8 is a transverse cross-section of a third combination hair dryer/styler device, similar to the second device shown in FIG. 7*a* but with the heater plates having rotational movement to move the hair within the chamber.

FIG. 8 illustrates a third embodiment of a combination hair dryer/styler device 10*b* (shown in transverse cross-section). This device 10*b* is similar to the device 10*a* of the second embodiment, as reflected by the use of like reference numerals, but with the heater plates 24*a-d* themselves being the vibrating members which impart vibration on the hair 40 in use. More particularly, the heater plates 24*a-d* are driven (and thereby caused to vibrate) by dedicated shafts (or so-called "flexi drive" connections), similar to shafts 34*a* and 34*b* shown in FIG. 7*a*. The heater plates 24*a-d* have rotational movement to provide a "scrunching" effect on the hair during the drying/styling process, as the heater plates 24*a-d* vibrate.

As illustrated, the device 10*b* further comprises a supplementary heater element 23 embedded beneath the surface of the plenum chamber 22 and configured to provide additional heating to the plenum chamber 22 and thus to the flow of air 32 and the length of hair 40 held within.

Mechanisms and Techniques for Imparting Vibration to Wet Hair

The present work contemplates a variety of possible alternative mechanisms and techniques for imparting vibration to wet hair, to cause clumped hairs to move and separate.

Figure 9A:
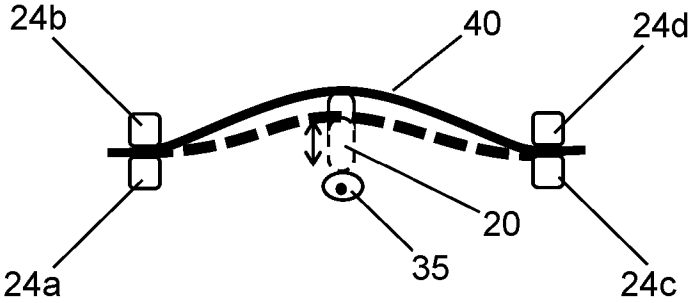
FIG. 9*a* is a side view of a first possible technique for imparting vibration to hair.

FIG. 9*a* illustrates a first technique, as employed in the above-described first embodiment, whereby one or more vibrating plate(s) 20 is/are driven in a reciprocating manner by a cam 35, at or near the midpoint of the length of hair 40 that is held between the heater plates 24*a-d*. If more than one vibrating plate is used in this location, the plates may be mounted on opposite arms of the device, so as to act in opposite directions.

Figure 9B:
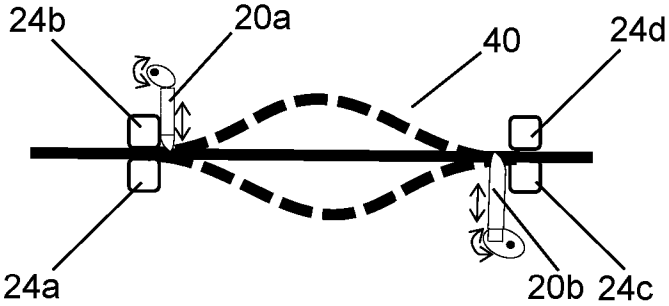
FIG. 9*b* is a side view of a second possible technique for imparting vibration to hair.

FIG. 9*b* illustrates a second technique, as employed in the above-described second embodiment, whereby two vibrating plates 20*a*, 20*b* act near each of the end nodes of the hair (the nodes being defined by the points where the hair is contacted by the heater plates 24*a-d*). The vibrating plates 20*a*, 20*b* are driven by a controller in synchronism with one another, so as to move in opposite directions to one other. That is to say, one vibrating plate (e.g. 20*a*) moves away from its respective arm whilst the other plate (e.g. 20*b*) moves towards its respective arm, and vice versa.

Other arrangements of one or more vibrating plates, or other vibrating members, may alternatively be used to impart vibration on the hair, as those skilled in the art will appreciate. For example, one or more rotating cam members or rods may be arranged to act directly on the hair, to impart vibrations directly to the hair, without the use of a vibrating plate.

Figure 10A:
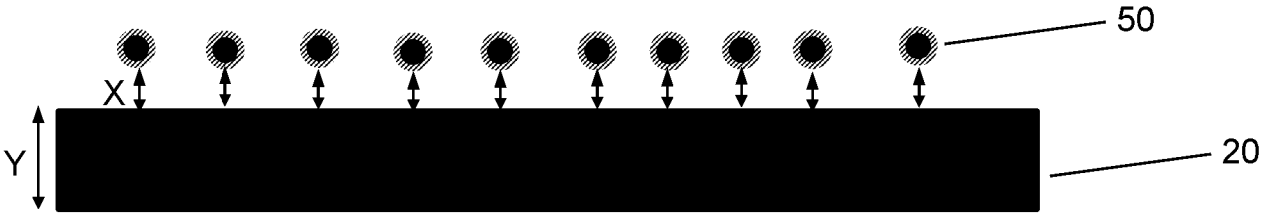
FIGS. 10*a* and 10*b* show cross-sectional views of possible geometries of a vibrating plate for imparting vibration to hair.

As illustrated in FIG. 10*a*, the or each vibrating plate 20 (shown here in longitudinal cross-section) may have a linear or planar surface, as a result of which the hairs 50 that contact the vibrating plate typically move away from the surface of the plate in a direction X that is substantially parallel to the direction of vibrational motion Y of the plate (as indicated by the double headed arrows in the figure).

Figure 10B:
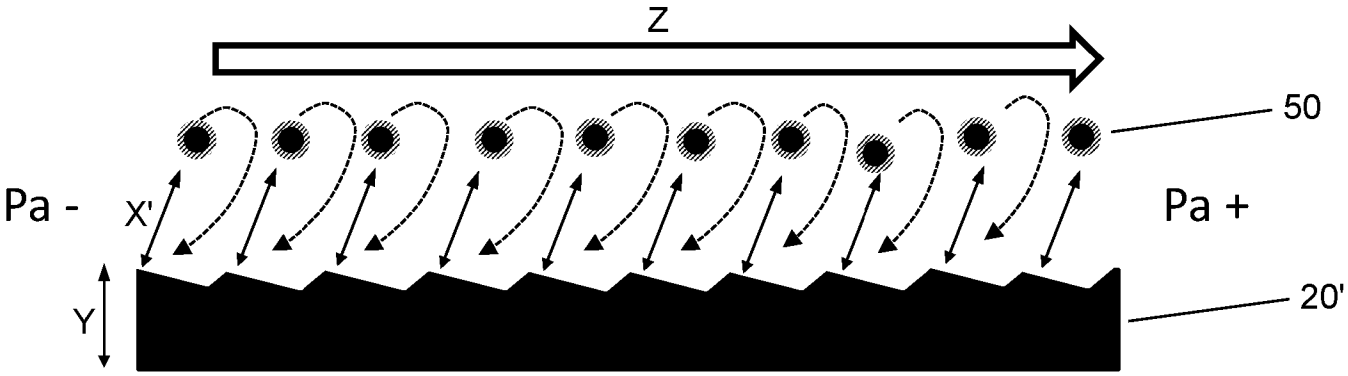

Whilst the plate geometry shown in FIG. 10*a* is effective in causing clumped wet hairs to move and separate, the variant shown in FIG. 10*b* has been developed to further improve the separation of clumped wet hairs as a result of vibration of the vibrating plate 20'. More specifically, vibrating plate 20' is formed with a nonplanar, ridged or contoured surface—for example having a jagged or saw-toothed profile as illustrated—as a result of which the hairs 50 that contact the vibrating plate are caused to move away from the plate in an initial direction X' that is not parallel to the direction of vibrational motion Y of the plate, but rather is at an angle to the direction of motion of the plate. The hairs 50 may then return towards the plate via a curved or more chaotic/random path, as illustrated schematically in the figure by the dashed arrows. As a consequence of imparting greater motion to the hairs 50 in this manner, the geometry of the vibrating plate 20' is more effective than the geometry of the vibrating plate 20' shown in FIG. 10*a* at causing clumped wet hairs to move and separate.

Furthermore, as a consequence of this motion path of the hairs 50, in this example the waste water separated from or evaporated from the hair has a tendency to move in the direction Z indicated by the large arrow in the figure (this direction Z effectively resulting from the asymmetric nature of each of the saw-toothed regions on the surface of the plate in this example). Naturally, this direction Z can be made to coincide with the direction of airflow 32 through the plenum chamber 22, thereby increasing the efficiency with which water can be removed from the hair and expelled from the dryer.

Figure 11A:
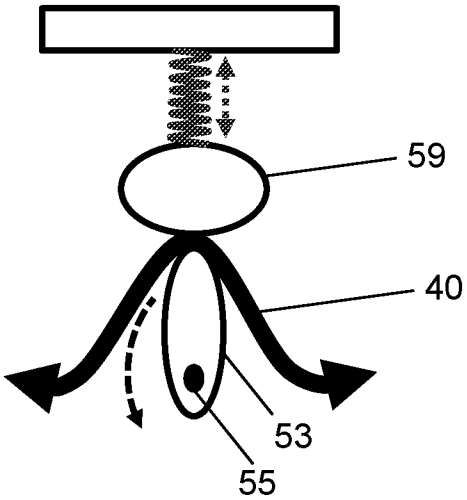
FIGS. 11*a* and 11*b* show cross-sectional views of alternative arrangements for imparting vibration to hair.
Figure 11B:
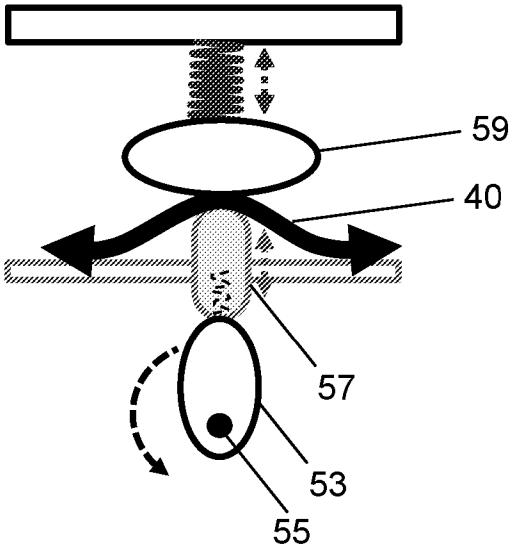

FIGS. 11*a* and 11*b* illustrate further alternatives for imparting vibration to the wet hair 40. In these alternatives, a cam 53 is mounted for rotation with the rotating shaft 55 of the motor (not shown). In FIG. 11*a*, the cam 53 directly contacts and moves the hair 40 as it rotates and in FIG. 11*b*, the cam 53 acts on a reciprocating member 57 which contacts the hair 40 causing the hair to be moved. A spring biased cam follower 59 is also provided to hold the hair against the cam 53 or the reciprocating member 57.

With regard to the techniques shown for example in FIGS. 9*a*, 9*b*, 10*a*, 10*b*, 11*a* and 11*b*, and also other possible arrangements of one or more vibrating plates (or other vibrating or rotating members), the or each vibrating plate (or other member) may be driven for example by any of the following mechanisms:

- an eccentric disc, driven by a rotary motor
- a cam (e.g. together with a spring or a cam follower), driven by a rotary motor
- a reciprocating wormdrive arrangement
- a crankshaft and a connecting rod, driven by a rotary motor
- a reciprocating solenoid Other mechanisms for imparting vibration to wet hair are also possible, as those skilled in the art will appreciate.

In general, it will be appreciated that the hair passes through the device in a first direction, and the means for imparting vibration are configured to vibrate the hair in a second direction transverse to the first direction. The second direction may be at an angle in the range of 35° to 145° relative to the first direction. In the presently-preferred embodiments the angle is approximately 90°.

Control Circuitry

Figure 12:
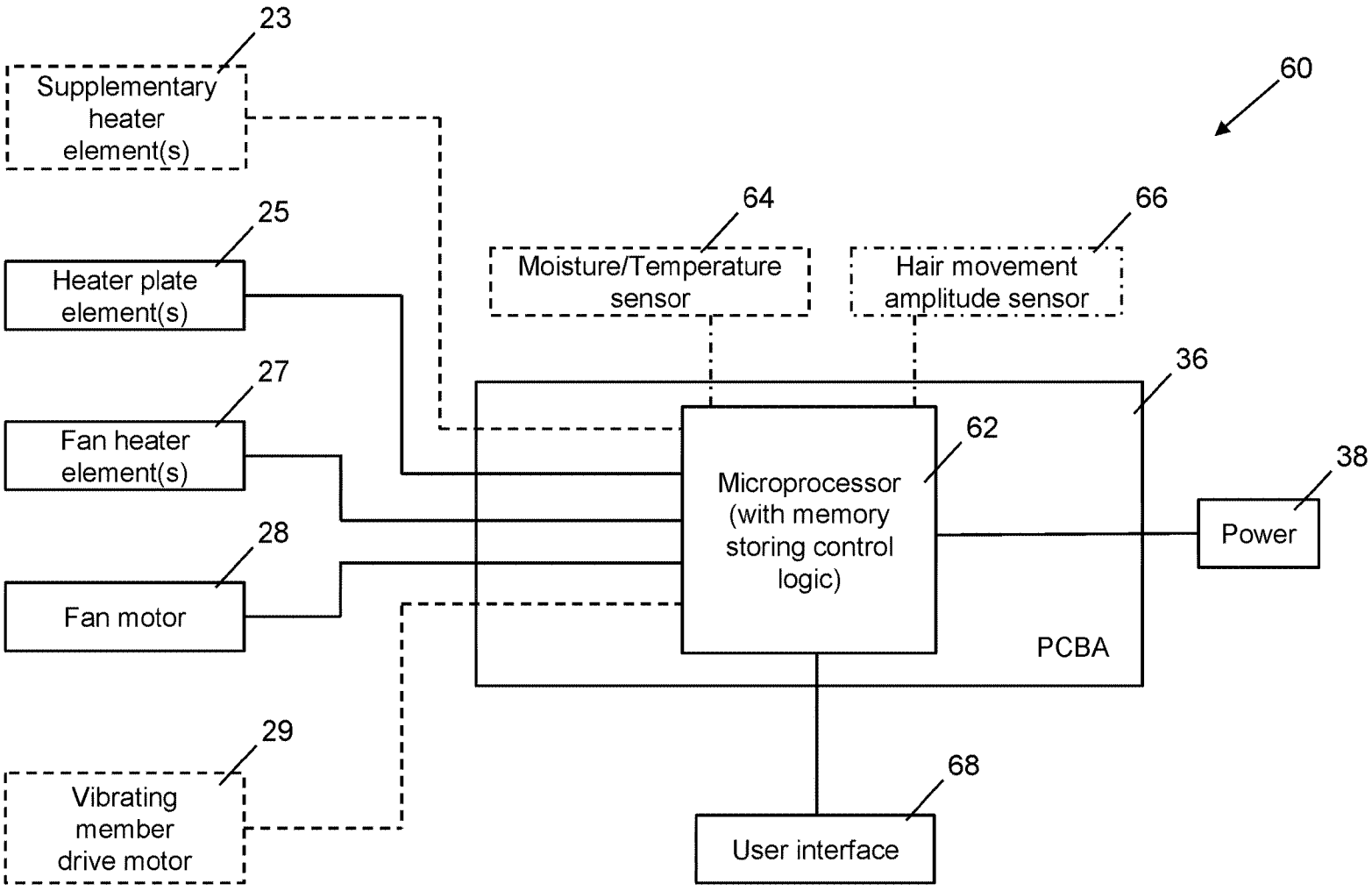
FIG. 12 illustrates an example of a control circuit for controlling a combination hair dryer/styler, showing optional elements for providing temperature and vibration feedback control.
Figure 13:
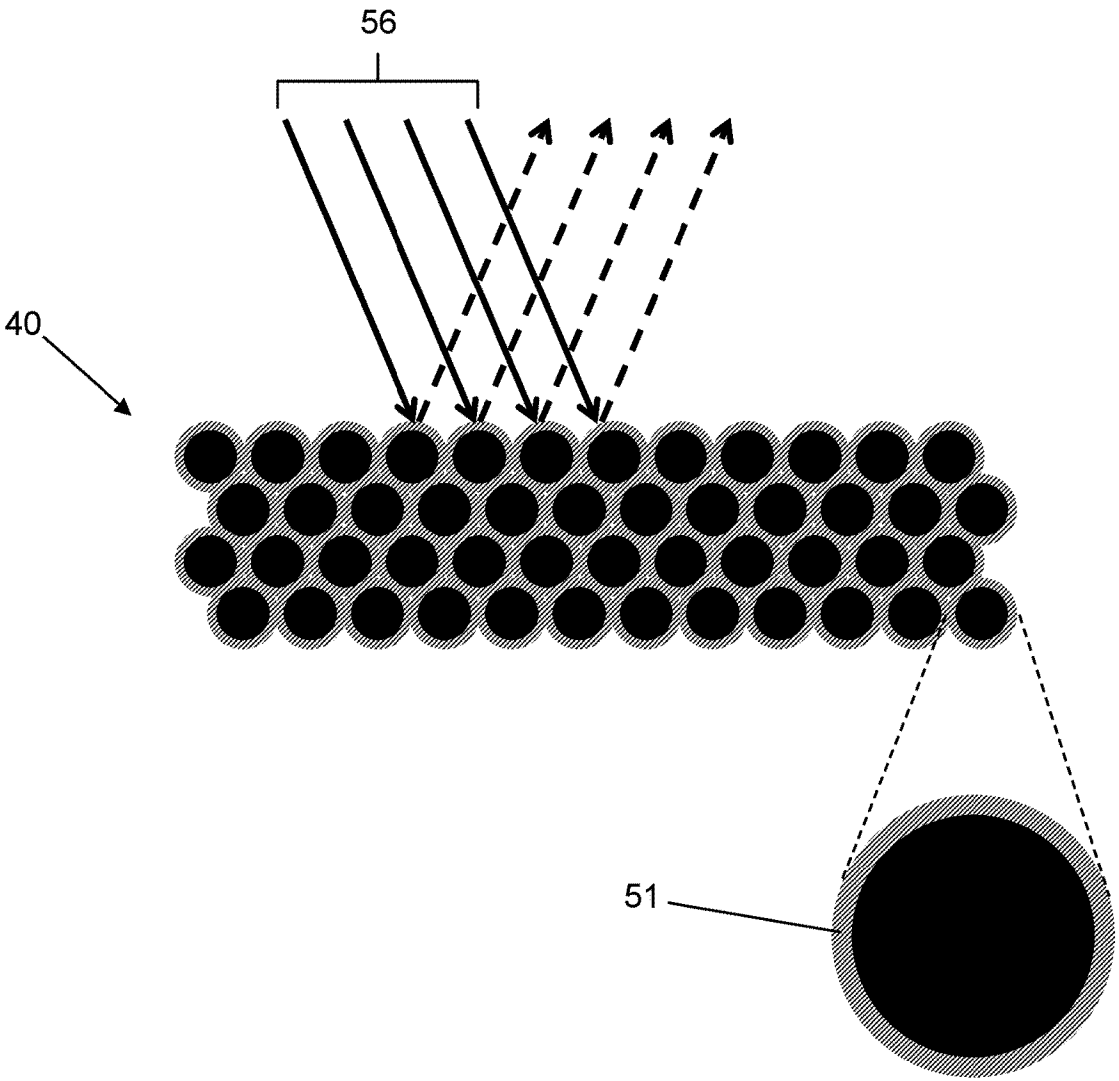
FIG. 13 is a cross-sectional schematic diagram to illustrate (by way of background information) problems associated with drying a clump of wet hair using hot air.

FIG. 12 shows an example of a control circuit 60 suitable for use in the devices 10, 10*a* and 10*b* of the above-described embodiments.

The control circuit 39 includes a microprocessor 62 mounted on the printed circuit board assembly 36, and configured to receive power from the power supply 38. Although not expressly shown, it will of course be appreciated that the other electrical components within the circuit 60 are also configured to receive power from the power supply 38. The microprocessor 62 is provided with a memory storing control logic, which is executed by the microprocessor 62 when carrying out its various functions. A user interface 68 is also connected to the microprocessor 62, enabling the user to control the functions of the device.

The microprocessor 62 is connected to the above-described heater plate element(s) 25 (e.g. 25*a-d*), the fan heater element(s) 27 and the fan motor 28, and is configured to control these components (i.e. to regulate the power to these components and to cause them to function as described above). Optionally, as shown for example in the embodiments of FIGS. 7/7*a* and 8, one or more supplementary heater elements 23 may also be controlled by the microprocessor 62.

As mentioned above, a moisture and/or temperature sensor 64 may optionally be provided in the plenum chamber 22 and/or at the inlet and/or outlet thereof. Signals representative of the sensed moisture level(s) or temperature(s) are supplied from the sensor 64 to the microprocessor 62 from which the microprocessor determines how wet or how dry the hair is that is being treated.

During use of the device 10/10*a*/10*b*, the microprocessor 62 may be configured to increase the temperature of the outlet heater plate element(s) 24 and/or the fan heater element(s) 27 and/or the supplementary heater element(s) 23 (if provided), when the hair is dry to allow improved styling of the hair. The microprocessor 62 may also be configured to reduce the speed of operation of the fan motor 28 in response to the detected moisture level of the hair decreasing, thereby saving energy.

Conversely, if the microprocessor determines that the hair is wet (by processing the signals from the sensor 64), for example due to movement of the device to a wetter section of hair, the microprocessor 62 may be configured to reduce the temperature of the heater plate element(s) 24 and/or the fan heater element(s) 27 and/or the supplementary heater element(s) 23 (if provided) in response, in order to prevent cavitation of water on the hair or denaturation of the hair. The microprocessor 62 may also be configured to increase the speed of operation of the fan motor 28 in response to the detected moisture level of the hair increasing.

Where temperature sensors are provided at both the inlet and the outlet of the device 10, the microprocessor 62 can determine from the sensed temperature difference between the inlet and the outlet, which way round (orientation) the user is using the device. This orientation information can be used by the microprocessor 62 to control the thermal power applied to the heater elements 24 so that the hair at the inlet is heated less than the hair at the outlet. Alternatively, where the device 10 has a product applicator (for applying a hair product such as a hair gel or the like) at both the inlet and the outlet, the microprocessor 24 can use the orientation information to control the applicators so that, for example, only the applicator at the inlet is used to apply the hair product. Alternatively, where the applicators are able to apply different hair products, the microprocessor 62 can use the orientation information to select the hair product to be applied by each applicator—so that, for example, hair products that would benefit from being dispersed throughout the hair are applied at the inlet side of the device (prior to the vibrating or rotating member) and hair products that may be used to protect the hair from the high temperatures of the outlet heaters are applied by the applicator positioned towards the outlet of the device 10 (prior to the outlet heaters).

Further, a sensor 66 may optionally be provided in the plenum chamber 22 to measure the amplitude of movement of the hair 40 therein, in response to the applied vibration from the vibrating plate(s) or other vibrating member(s). The sensor 66 may be, for example, an optical sensor configured to detect the extent to which the vibrated hair moves across its "field of view". A signal representative of the detected amplitude of movement is supplied from the detector 64 to the microprocessor 62. With the aim of maximising (or achieving a predetermined level of) the measured amplitude of movement of the hair (e.g. by virtue of resonance) and thereby improving the efficiency of the drying process, the microprocessor 62 may be configured to adjust (e.g. periodically), in response to the measured amplitude of movement, the frequency of the vibrations applied to the hair 40 by the or each vibrating member—i.e. as a feedback process. This may be achieved by the microprocessor 62 adjusting the speed of operation of the fan motor 28 (if the vibrating plate(s)/member(s) are also driven by the fan motor 28, as in the case of the device 10 of the first embodiment), or by adjusting the speed of operation of the vibrating member drive motor 29 (or the frequency of operation of the abovementioned solenoid(s) or other frequency drive means) if the vibrating plate(s)/member(s) are driven separately from the fan, as in the case of the device 10*a* of the second embodiment.

Modifications and Alternatives

Detailed embodiments and some possible alternatives have been described above. As those skilled in the art will appreciate, a number of modifications and further alternatives can be made to the above embodiments whilst still benefiting from the inventions embodied therein. It will therefore be understood that the invention is not limited to the described embodiments and encompasses modifications apparent to those skilled in the art lying within the scope of the claims appended hereto.

For example, in some of the above embodiments, the device had a vibrating or rotating member (such as a vibrating plate) over which the hair was constrained to pass. As those skilled in the art will appreciate, multiple vibration or rotating members may be provided longitudinally within the device so that different hairs within the clump of hair that is drawn through the device are vibrated by different members.

In all of the embodiments described above, heating plates were provided symmetrically on either side of the plenum chamber. However, as those skilled in the art will appreciate, one or more heating plates may be provided on just one side of the chamber. In this case, the device can only be used to dry hair by passing the hair through the device in one direction.

In the above embodiments, heater plates were provided at the input side and the output side of the plenum chamber. However, as those skilled in the art will appreciate, it is not necessary that these plates are heated. The squeegeeing effect of the plates may be sufficient in some circumstances to dry the hair in combination with the vibrational drying. However, having at least one heated plate is preferred as it helps with the drying process.

Finally, as mentioned earlier, whilst the above embodiments include a fan or other means for generating a flow of air, alternative embodiments can be realised in which a fan or other means for generating a flow of air is not provided, instead relying on the vibration imparted to the hair (potentially in combination with the abovementioned squeegeeing effect) to cause the hair to dry.

Figure 14:
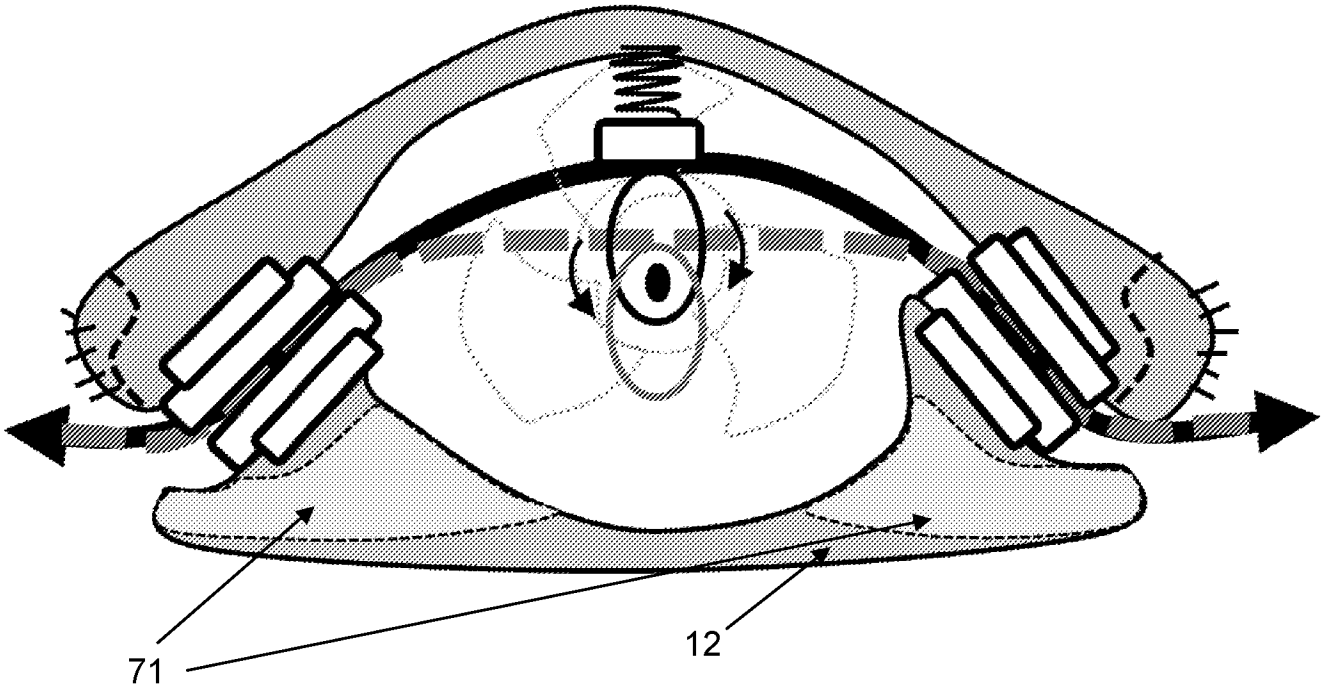
FIG. 14 schematically illustrates in transverse cross-section an alternative dryer/styler having air vents to allow air drawn or blown through the device to be directed towards the roots of a user's hair during use.

In the second embodiment described above, a diffuser 44 was provided on the air outlet from the chamber. This allowed some of the air to be directed towards the roots of the user's hair during use. Is an alternative arrangement, air channels or vents may be provided through the side of one or both of the first and second arms 12, 14 so that air drawn or blown through the chamber can pass out through these air vents towards the roots of the user's hair during use. Such an embodiment is illustrated schematically in FIG. 14, by the vents 71 provided in the arm 12.

In the first embodiment described above, the arm 14 was bifurcated. In an alternative embodiment, the arm 14 may be bifurcated in the middle but both ends of the arm may be joined together.

Throughout the description and claims of this specification, the words "comprise" and "contain" and variations of the words, for example "comprising" and "containing", means "including but not limited to", and is not intended to (and does not) exclude other components, integers or steps.

The invention claimed is:

1. Apparatus for drying hair, comprising:

a first arm and a second arm, mutually-opposing each other, the first arm and the second arm adapted for movement between an open configuration for receiving a length of wet hair therebetween and a closed configuration adjacent the hair;

one or more vibrating or rotating members arranged to impart vibration from at least one of said arms to said length of hair in use, to move and separate hair fibres for improving drying of the hair; and wherein the first and second arms, when in the closed configuration, define a chamber across which, in use, the hair passes and within which the hair is free to move, and wherein the one or more vibrating or rotating members causes the length of hair to move and separate within said chamber, and wherein the one or more vibrating or rotating members comprise one or more mechanical vibration-imparting members mounted on the at least one arms and configured to move relative to the at least one arms in order to impart the vibration to said length of hair.

2. Apparatus according to claim 1, wherein the one or more vibrating or rotating members are inside the chamber.

3. Apparatus according to claim 1, configured such that the hair passes through the apparatus in a first direction, and the one or more vibrating or rotating members are configured to vibrate the hair in a second direction that lies at an angle to the first direction.

4. Apparatus according to claim 3, wherein the angle is in the range of 35° to 145°.

5. Apparatus according to claim 4, wherein the angle is approximately 90°.

6. Apparatus according to claim 1, wherein the one or more vibrating or rotating members are configured to impart vibration at a frequency and amplitude sufficient to break surface tension between adjacent wet hair fibres, and thereby cause hairs, which have clumped together within said length of hair, to move and separate.

7. Apparatus according to claim 1, further comprising means for blowing or drawing air through said length of hair.

8. Apparatus according to claim 7, further comprising means for heating said air.

9. Apparatus according to claim 7, wherein the means for blowing or drawing air are arranged to blow or draw air though the hair in the chamber.

10. Apparatus according to claim 1, further comprising one or more plates disposed on the first and second arms, the one or more plates being arranged to contact the hair when the first and second arms are in the closed configuration.

11. Apparatus according to claim 10, comprising mutually-opposing plates disposed on the first and second arms, the mutually-opposing plates being arranged to come together when the first and second arms are in the closed configuration.

12. Apparatus according to claim 11, wherein a first plate and a second plate are disposed on the first arm, and respective opposing first and second plates are disposed on the second arm.

13. Apparatus according to claim 12, wherein one of the first and second arms is bifurcated to form a first sub-region and a second sub-region, the first plate of the first arm being disposed on the first sub-region and the second plate of the first arm being disposed on the second sub-region.

14. Apparatus according to claim 12, wherein the plates are incorporated in walls of the chamber formed when the first and second arms are in the closed configuration.

15. Apparatus according to claim 10, wherein at least one of said plates comprises means for applying heat to said length of hair in use, when the first and second arms are in the closed configuration.

16. Apparatus according to claim 15, wherein said at least one of said plates is also arranged to heat the chamber in use.

17. Apparatus according to claim 1, further comprising means for heating the chamber, disposed on or within walls of the chamber.

18. Apparatus according to claim 7, further comprising a moisture sensor arranged to sense, in use, moisture level of the hair and/or a temperature sensor arranged, in use, to sense temperature of the hair, and a controller configured to adjust, in dependence on sensed moisture level of the hair or sensed temperature of the hair, one or more of:

a rate with which air is blown or drawn though the chamber, temperature to which said air is heated, temperature of said at least one of said plates, and/or temperature to which the chamber is heated.

19. Apparatus according to claim 1, further comprising a sensor arranged to measure, in use, amplitude of movement of the hair due to the imparted vibration, and a controller configured to adjust frequency and/or amplitude of the imparted vibration so as to substantially maximise, or achieve a predetermined level of, measured amplitude of movement of the hair.

20. Apparatus according to claim 1, wherein the one or more vibrating or rotating members are arranged to contact the hair in use.

21. Apparatus according to claim 1, wherein each vibrating or rotating member extends away from the surface of at least one of the first and second arms and is arranged such that a surface of the vibrating or rotating member contacts the hair in use.

22. Apparatus according to claim 1, wherein each vibrating or rotating member extends longitudinally with respect to the chamber.

23. Apparatus according to claim 1, comprising a single vibrating or rotating member arranged along substantially a midpoint of one of the first and second arms.

24. Apparatus according to claim 1, comprising first and second vibrating or rotating members respectively arranged on the first and second arms.

25. Apparatus according to claim 24, wherein the first and second vibrating or rotating members are driven in synchronism with one another such that the first vibrating or rotating member moves away from a respective arm whilst the second vibrating or rotating member moves towards a respective arm, and vice versa.

26. Apparatus according to claim 25, wherein the first and second vibrating or rotating members are respectively arranged along substantially a midpoint of a first and second arms.

27. Apparatus according to claim 26, wherein the first vibrating or rotating member is arranged towards a side of the first arm, and the second vibrating member is arranged towards a side of the second arm.

28. Apparatus according to claim 1, wherein a surface of each of the first and second vibrating or rotating members that contacts the hair in use has a nonplanar profile configured to cause hairs that contact the first or second vibrating or rotating member to move away from the first or second vibrating or rotating member in a direction that is not parallel to a direction of motion of the first or second vibrating or rotating member.

29. Apparatus according to claim 1, wherein each vibrating or rotating member comprises a vibrating or rotating plate.

30. Apparatus according to claim 1, further comprising one or more plates disposed on the first and second arms, the one or more plates being arranged to contact the hair when the first and second arms are in the closed configuration and wherein each of the one or more vibrating or rotating members comprises one of the one or more plates.

31. Apparatus according to claim 1, wherein each vibrating or rotating member comprises a cam, an eccentric disc or a rod arranged to contact the hair in use.

32. Apparatus according to claim 1, further comprising a motor arranged to drive each vibrating or rotating member via a shaft of the motor or via a flexi-drive.

33. Apparatus according to claim 32, further comprising means for blowing or drawing air through said length of hair and wherein the means for blowing or drawing air comprises a fan, and the motor is arranged to drive said fan.

34. Apparatus according to claim 32, further comprising means for blowing or drawing air through said length of hair and wherein the means for blowing or drawing air comprises a fan, the fan having a motor separate from that which is arranged to drive each vibrating or rotating member.

35. Apparatus according to claim 32, further comprising an eccentric disc or cam for driving each vibrating or rotating member.

36. Apparatus according to claim 32, further comprising a wormdrive arrangement for driving each vibrating or rotating member.

37. Apparatus according to claim 32, further comprising a crankshaft and a connecting rod for driving each vibrating or rotating member.

38. Apparatus according to claim 1, further comprising a reciprocating solenoid arranged to drive each vibrating or rotating member.

39. Apparatus according to claim 1, wherein the one or more vibrating or rotating members are driven at a frequency in the range of 10 Hz to 1 kHz.

40. Apparatus according to claim 1, wherein the one or more vibrating or rotating members are driven at a frequency in the range of 20 Hz to 60 Hz.

41. Apparatus according to claim 1, wherein the one or more vibrating or rotating members are driven at a frequency in the range of 40 Hz to 50 Hz.

42. Apparatus according to claim 1, wherein the one or more vibrating or rotating members are driven with amplitude of vibration in the range of 0.5 mm to 20 mm.

43. Apparatus according to claim 1, wherein the one or more vibrating or rotating members are driven with an amplitude of vibration in the range of 0.5 mm to 10 mm.

44. Apparatus according to claim 1, wherein the one or more vibrating or rotating members are driven with an amplitude of vibration in the range of 2.5 mm to 5 mm.

45. Apparatus according to claim 1 further comprising means for applying a hair product to the hair during or prior to said one or more vibrating or rotating members moving and separating said hair fibres.

46. Apparatus according to claim 45, wherein said means for applying a hair product includes means for atomising the hair product.

47. A method of drying hair comprising using the apparatus according to claim 1 to impart vibration to a length of wet hair held within the apparatus, the vibration causing hair fibres within said length of wet hair to move and separate.

48. The method of claim 47, further comprising using the apparatus to style the hair substantially simultaneously with drying the hair.

* * * * *